US008177939B2

(12) United States Patent
Moncla et al.

(10) Patent No.: US 8,177,939 B2
(45) Date of Patent: May 15, 2012

(54) CELLULOSE ARTICLES CONTAINING AN ADDITIVE COMPOSITION

(75) Inventors: Brad M. Moncla, Lake Jackson, TX (US); Ronald Wevers, Terneuzen (NL); Wenbin Liang, Pearland, TX (US); Henk Felix, Haarlem (NL); Michael R. Lostocco, Appleton, WI (US); Troy M. Runge, Neenah, WI (US); Thomas J. Dyer, Neenah, WI (US); Deborah J. Nickel, Appleton, WI (US); Johan Vanrijsbergen, Maarssen (NL)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 13/218,570

(22) Filed: Aug. 26, 2011

(65) Prior Publication Data

US 2011/0308751 A1 Dec. 22, 2011

Related U.S. Application Data

(62) Division of application No. 12/097,407, filed as application No. PCT/US2006/046495 on Dec. 4, 2006, now Pat. No. 8,029,646.

(60) Provisional application No. 60/750,466, filed on Dec. 15, 2005.

(51) Int. Cl.
*D21F 11/00* (2006.01)

(52) U.S. Cl. ..... 162/157.6; 162/168.1

(58) Field of Classification Search ..... 162/157.6, 162/168.1; 524/35

See application file for complete search history.

(56) References Cited

U.S. PATENT DOCUMENTS

| | | | |
|---|---|---|---|
| 3,585,104 | A | 6/1971 | Kleinert |
| 3,645,992 | A | 2/1972 | Elston |
| 4,076,698 | A | 2/1978 | Anderson et al. |
| 4,297,860 | A | 11/1981 | Pacifici et al. |
| 4,514,345 | A | 4/1985 | Johnson et al. |
| 4,528,239 | A | 7/1985 | Trokhan |
| 4,529,480 | A | 7/1985 | Trokhan |
| 4,556,450 | A | 12/1985 | Chuang et al. |
| 4,594,130 | A | 6/1986 | Chang et al. |
| 4,599,392 | A | 7/1986 | McKinney et al. |
| 4,773,110 | A | 9/1988 | Hopkins |
| 4,775,713 | A | 10/1988 | Homma et al. |
| 4,793,898 | A | 12/1988 | Laamanen et al. |
| 4,798,081 | A | 1/1989 | Hazlitt et al. |
| 4,988,781 | A | 1/1991 | McKinney et al. |
| 5,098,522 | A | 3/1992 | Smurkoski et al. |
| 5,230,776 | A | 7/1993 | Andersson et al. |
| 5,260,171 | A | 11/1993 | Smurkoski et al. |
| 5,272,236 | A | 12/1993 | Lai et al. |
| 5,275,700 | A | 1/1994 | Trokhan |
| 5,278,272 | A | 1/1994 | Lai et al. |
| 5,334,289 | A | 8/1994 | Trokhan et al. |
| 5,353,521 | A | 10/1994 | Orloff |
| 5,496,624 | A | 3/1996 | Stelljes, Jr. et al. |
| 5,504,172 | A | 4/1996 | Imuta et al. |
| 5,595,628 | A | 1/1997 | Gordon et al. |
| 5,598,642 | A | 2/1997 | Orloff et al. |
| 5,598,643 | A | 2/1997 | Chuang et al. |
| 5,628,876 | A | 5/1997 | Ayers et al. |
| 5,637,194 | A | 6/1997 | Ampulski et al. |
| 5,677,383 | A | 10/1997 | Chum et al. |
| 5,756,659 | A | 5/1998 | Hughes et al. |
| 5,844,045 | A | 12/1998 | Kolthammer et al. |
| 5,869,575 | A | 2/1999 | Kolthammer et al. |
| 5,938,437 | A | 8/1999 | DeVincenzo |
| 5,948,507 | A | 9/1999 | Chen et al. |
| 6,010,598 | A | 1/2000 | Boutilier et al. |
| 6,096,169 | A | 8/2000 | Hermans et al. |
| 6,111,023 | A | 8/2000 | Chum et al. |
| 6,143,135 | A | 11/2000 | Hada et al. |
| 6,316,549 | B1 | 11/2001 | Chum et al. |
| 6,372,091 | B2 | 4/2002 | Wildfong et al. |
| 6,423,183 | B1 | 7/2002 | Goulet et al. |
| 6,448,341 | B1 | 9/2002 | Kolthammer et al. |
| 6,455,636 | B2 | 9/2002 | Sanada et al. |
| 6,538,070 | B1 | 3/2003 | Cardwell et al. |
| 6,566,446 | B1 | 5/2003 | Parikh et al. |
| 6,702,925 | B2 | 3/2004 | Bricco et al. |
| 6,808,595 | B1 | 10/2004 | Burns et al. |
| 6,824,650 | B2 | 11/2004 | Lindsay et al. |
| 6,837,970 | B2 | 1/2005 | Ko et al. |
| 6,863,940 | B2 | 3/2005 | Silver et al. |
| 6,897,168 | B2 | 5/2005 | Branham et al. |
| 6,949,167 | B2 | 9/2005 | Shannon et al. |
| 2004/0149412 | A1 | 8/2004 | Tammi et al. |
| 2005/0014013 | A1 | 1/2005 | Daniels et al. |
| 2005/0023007 | A1 | 2/2005 | Nappa et al. |

(Continued)

FOREIGN PATENT DOCUMENTS

| | | | |
|---|---|---|---|
| CN | 1687523 | A | 10/2005 |

(Continued)

OTHER PUBLICATIONS

Williams, T., et al., The Construction of a Polyethylene Calibration Curve for Gel Permeation Chromatography Using Polystyrene Fractions, Journal of Polymer Science: Polymer Letters, 1968, pp. 621-624, vol. 6, H.H. Wills Physics Laboratory, England.

(Continued)

*Primary Examiner* — Mark Halpern

(57) ABSTRACT

In one embodiment, the present invention provides a method of forming a cellulose article having a specific volume of less than 3 cc/gm. The method includes the step of incorporating cellulose fibers with a compound, wherein the compound includes an aqueous dispersion. The aqueous dispersion may have at least one polymer selected from the group consisting of an ethylene-based thermoplastic polymer, a propylene-based thermoplastic polymer, and mixtures thereof; at least one polymeric stabilizing agent; and water. In certain embodiments, a combined amount of the at least one polymer and the at least one stabilizing agent comprises about 25 to about 74 volume percent of the aqueous dispersion.

10 Claims, 5 Drawing Sheets

U.S. PATENT DOCUMENTS

| | | | |
|---|---|---|---|
| 2005/0100754 | A1 | 5/2005 | Moncla et al. |
| 2005/0192365 | A1 | 9/2005 | Strandburg et al. |
| 2005/0192402 | A1 | 9/2005 | Antal et al. |

FOREIGN PATENT DOCUMENTS

| | | | | |
|---|---|---|---|---|
| DE | 10109992 | | | 9/2002 |
| EP | 0 972 794 | | | 1/2000 |
| JP | 55-093899 | A | | 7/1980 |
| JP | 55-093900 | A | | 7/1980 |
| WO | WO-98/03731 | | | 1/1998 |
| WO | WO-98/38374 | | | 9/1998 |
| WO | WO-99/24492 | | | 5/1999 |
| WO | WO 99/24492 | | * | 5/1999 |
| WO | WO-00/01745 | A1 | | 1/2000 |
| WO | WO-01/12414 | | | 2/2001 |
| WO | WO-01/49937 | | | 7/2001 |
| WO | WO-2005/021622 | A2 | | 3/2005 |
| WO | WO-2005/021638 | | | 3/2005 |
| WO | WO-2005/090427 | | | 9/2005 |
| WO | WO-2006/127080 | | | 11/2006 |
| WO | WO-2007/008558 | | | 1/2007 |

OTHER PUBLICATIONS

Wild, L. et al., Determination of Branching Distributions in Polyethylene and Ethylene Copolymers, Journal of Polymer Science: Polymer Physics Edition, 1982, pp. 441-455, vol. 20, John Wiley & Sons, Inc.

Randall, J.C., A Review of High Resolution Liquid $^{13}$Carbon Nuclear Magnetic Resonance Characterizations of Ethylene-Based Polymers, JMS-Rev. Macromol. Chem. Phys., 1989, pp. 201-317, C29 (2 & 3), Baytown Polymers Center, Texas.

PCT/US2006/046495 International Preliminary Report on Patentability.

PCT/US2006/046495 International Search Report.

PCT/US2006/046495 Written Opinion.

* cited by examiner

CELLULOSE ARTICLES CONTAINING AN ADDITIVE COMPOSITION

CROSS-REFERENCE TO RELATED APPLICATIONS

This application is a divisional application claiming the benefit of U.S. non-provisional application Ser. No. 12/097,407, filed on Jun. 13, 2008, entitled "CELLULOSE ARTICLES CONTAINING AN ADDITIVE COMPOSITION," which is a 371 national stage application of international application Ser. No. PCT/US2006/046495, filed on Dec. 4, 2006, which claims priority from the provisional application Ser. No. 60/750,466, filed on Dec. 15, 2005 entitled "IMPROVED CELLULOSE ARTICLES CONTAINING AN ADDITIVE COMPOSITION" the teachings of which are incorporated by reference herein as if reproduced in full hereinbelow.

BACKGROUND OF INVENTION

1. Field of the Invention

The invention relates generally to cellulose-based articles and a method to improve properties of the cellulose-based articles, including the water resistance, oil and grease resistance, wet and dry strength, or softness of the articles.

2. Background Art

Cellulose-based compositions are used in a wide range of products, and can include general categories such as paper and paper-board. Specific end use products range from sanitary napkins, cardboard boxes, paper (writing, copying, photographic, etc.), wet wipes, paper plates, food containers, and many others. Many of these products also include folds or bends, such as compartments in a paper plate or food container, creating additional manufacturing concerns.

Cellulose-based compositions are often modified for end-use applications. Various chemicals added to these cellulose-based compositions can improve desired properties, such as wet and dry strength, softness, water resistance, oil and grease resistance, and others. Unfortunately, however, when steps are taken to increase one property of the product, other characteristics of the product are often adversely affected.

As one example of modifying a cellulose-based composition, in the area of oil and grease resistance, there are many packages, such as pizza boxes and hamburger wrappers, which must be treated to prevent the unsightly staining of the package by the oil and grease from the food or other items that are packaged. Current treatments used for oil and grease resistance include treatment with fluorocarbons or extrusion coating the paper with a layer of polymer, such as LDPE. Fluorocarbon treatment often causes issues with consumer perception; LDPE coating often requires a high coating thickness, increasing costs.

As another example, water resistance/barrier is another important attribute needed in many paper and board applications, including corrugated boxes for cool storage of fruits and vegetables, as well as fish and meat packaging. Wax coatings are often used to provide the needed water resistance. These wax coatings are typically costly due to the high coating thickness required. The wax coatings also cause problems as the waxed boxes cannot be recycled in the same way as non-waxed boxes.

As a third example of enhancing the performance of cellulose-based compositions, photographic quality paper is often based on a multilayer design which consists of a paper substrate with a water impermeable polymer layer. This is often further coated with an overcoat of a water absorbent layer, and optionally an ink-receptive top layer (often containing cationic functionality to bind with pigments).

The above examples illustrate coating a cellulose-based composition with a polymer or other chemical after forming the paper or board. A polymer coating can be formed by processes such as spraying a polymer dispersion onto the paper, or by coextruding a polymer layer, for example. Dispersions or emulsions have also been added to an aqueous suspension containing cellulosic fibers, optional fillers and various additives. The aqueous suspension is fed into a headbox ejecting the suspension onto a wire where a wet web of paper is formed. The water drained from the wire, referred to as white water, is usually partly recirculated in the papermaking process.

Several references disclose the use of various thermoplastic dispersions, as a coating on paper and other substrates, to impart specific properties including heat sealability, water and or oil barrier, including WO2005/021638, DE10109992, and EP0972794. WO99/24492 discloses the use of certain polyolefin dispersions, specifically ethylene-styrene interpolymers, for use as a barrier coating on paper. WO98/03731 discloses the use of a dispersion of ethylene-acrylic acid copolymer (EAA) added in the wet end of the papermaking process to impart sizing (water resistance) to the finished "cellulosic article." U.S. Pat. No. 4,775,713 discloses aqueous dispersions containing various thermoplastics and a thermoplastic polymer containing a carboxylic acid salt group.

Another important attribute for efficient operations within a paper mill is the ability to reclaim or recycle materials used in the process, such as white water recirculation and the rebroking of edge trim and paper made during startup and shutdown (transforming the paper back into a slurry of pulp). The coating of the cellulosic fibers after forming a web of paper, or paper-board can have negative effects on the rebrokeability of the paper. Dispersions added to the process prior to forming the paper can negatively affect white water recirculation.

Accordingly, there exists a need for determining dispersion compositions useful as a paper coating or additive to enhance specific performance attributes. There also exists a need to determine a narrower range of dispersion compositions which can enhance specific performance attributes while not adversely affecting other attributes, such as improving strength while maintaining softness, for example. Further, there exists a need to determine methods and compositions which allow the recycling and reclamation of process materials to improve the manufacturing efficiency and cost of the papermaking process.

SUMMARY OF INVENTION

In one aspect, embodiments of the invention relate to cellulose-based articles having a specific volume of less than 3 cc/gm, for example, paper and board structures, incorporating a compound comprising an aqueous polyolefin dispersion resulting in articles having improved properties. In various embodiments, the articles can have improved oil and grease resistance, improved water resistance, controlled coefficients of friction, thermal embossability, thermalformability, improved wet and dry strength, or an improved softness, among others.

In one embodiment, the present invention provides a method of forming a cellulose article having a specific volume of less than 3 cc/gm including: incorporating cellulose fibers with a compound, wherein the compound includes an aqueous dispersion having: at least one polymer selected from the group consisting of an ethylene-based thermoplastic polymer, a propylene-based thermoplastic polymer, and mixtures thereof; at least one polymeric stabilizing agent; water; and wherein a combined amount of the at least one polymer and the at least one stabilizing agent comprises about 25 to about 74 volume percent of the aqueous dispersion.

In another embodiment, the present invention provides a cellulose-based article having a specific volume of less than 3 cc/gm including: a cellulose-based composition; and an applied compound. The applied compound, at the time of application, may include an aqueous dispersion having: at least one polymer selected from the group consisting of an ethylene-based thermoplastic polymer, a propylene-based thermoplastic polymer, and mixtures thereof; at least one polymeric stabilizing agent, wherein the stabilizing agent comprises a partially or fully neutralized ethylene-acid copolymer; and water. The article may have an oil and grease resistance value of at least 9 as measured using the Kit test at an exposure time of 15 seconds.

In another embodiment, the present invention provides a cellulose-based article having a specific volume of less than 3 cc/gm including: a cellulose-based composition; and an applied compound. The applied compound, at the time of application, may include an aqueous dispersion having at least one polymer selected from the group consisting of an ethylene-based thermoplastic polymer, a propylene-based thermoplastic polymer, and mixtures thereof; at least one polymeric stabilizing agent, and water. The stabilizing agent may include a partially or fully neutralized ethylene-acid copolymer. The cellulose-based article may have a water resistance value of less than about 10 $g/m^2/120$ seconds as measured via the Cobb test.

In other embodiments, the present invention provides a cellulose-based article having a specific volume of less than 3 cc/gm formed by a process including the steps of providing pulp fibers to the process, and incorporating the fibers with a compound. The compound may include an aqueous dispersion having: at least one polymer selected from the group consisting of an ethylene-based thermoplastic polymer, a propylene-based thermoplastic polymer, and mixtures thereof; at least one polymeric stabilizing agent; and water. The process may include: forming an aqueous suspension of the pulp fibers; forming the aqueous suspension into a paper web; and drying the paper web.

In other embodiments, the present invention provides a method of forming a cellulose article having a specific volume of less than 3 cc/gm including the steps of applying a compound to a cellulose-based composition; forming an aqueous suspension of the cellulose based composition; forming the aqueous suspension into a paper web; drying the paper web. The compound may include an aqueous dispersion having: at least one polymer selected from the group consisting of an ethylene-based thermoplastic polymer, a propylene-based thermoplastic polymer, and mixtures thereof; at least one polymeric stabilizing agent; and water.

Other aspects and advantages of the invention will be apparent from the following description and the appended claims.

DETAILED DESCRIPTION

Figure 1:
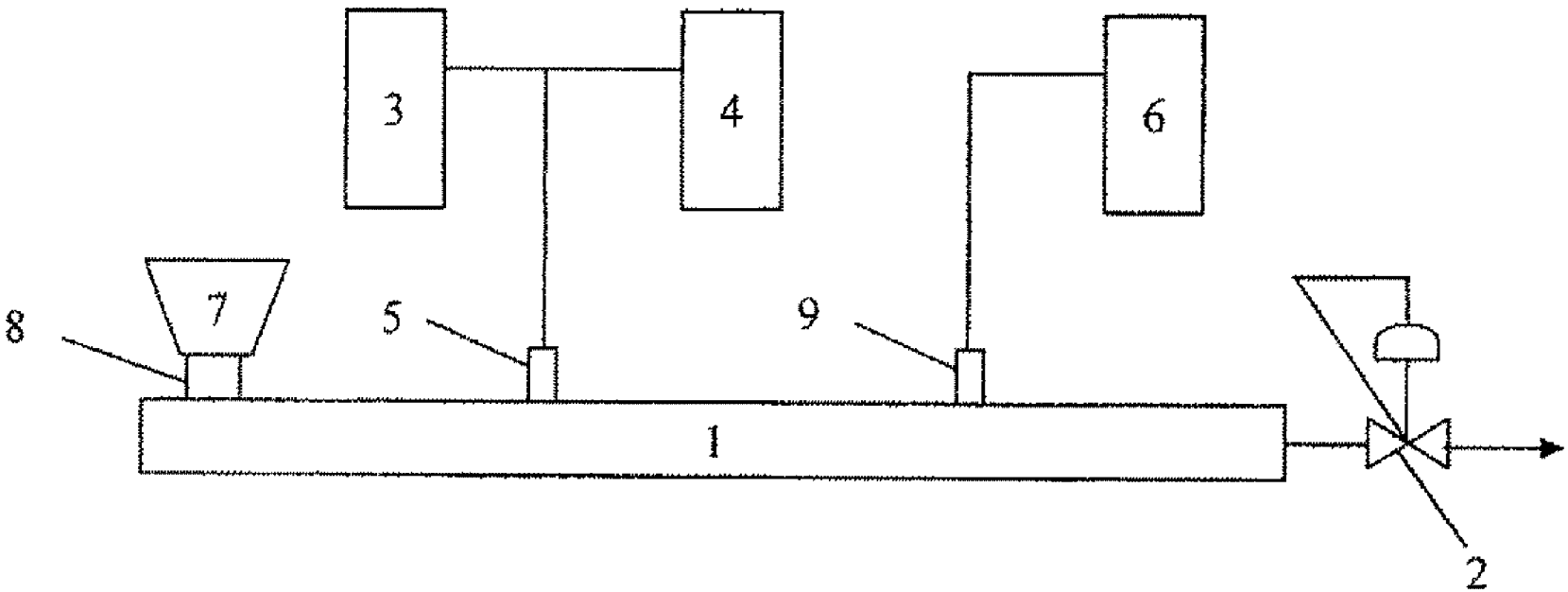
FIG. 1 is a schematic diagram of a process useful for forming the dispersion of certain embodiments of the present invention.

In one aspect, embodiments of the invention relate to cellulose-based articles, for example, paper and board structures, incorporating a compound comprising an aqueous polyolefin dispersion resulting in articles having improved properties. In various embodiments, the articles can have improved oil and grease resistance, improved water resistance, controlled coefficients of friction, thermal embossability, thermalformability, improved wet and dry strength, or an improved softness, among others. The incorporation of the compound comprising an aqueous polyolefin dispersion with, in, or on cellulose-based articles can, for example, result in oil and grease resistant paper and paper board for use in applications such as pizza boxes, hamburger wrappers, and corrugated produce boxes. In other embodiments, the incorporation can result in an improved photographic quality inkjet paper.

As used herein, "copolymer" refers to a polymer formed from two or more comonomers.

The cellulose-based articles of the present invention may be formed by incorporating a cellulose-based composition with a compound comprising an aqueous dispersion, where the dispersion comprises a base polymer and a stabilizing agent. The following description will first detail the compound and the aqueous dispersion. The cellulose-based composition will then be discussed, followed by a description of the manners in which the dispersion may be incorporated on or into the cellulose-based composition.

Dispersion or Dispersion Compounds

In certain embodiments, a filler can be added to the dispersion to form a dispersion compound. For simplicity and clarity, dispersions and dispersion compounds will generally be referred to as dispersions herein.

Base Polymers

Embodiments of the present invention employ ethylene-based polymers, propylene-based polymers, and propylene-ethylene copolymers as one component of a composition.

In selected embodiments, one component is formed from ethylene-alpha olefin copolymers or propylene-alpha olefin copolymers. In particular, in preferred embodiments, the base polymer comprises one or more non-polar polyolefins.

In other selected embodiments, olefin block copolymers, e.g. ethylene multi-block copolymer, such as those described in the International Publication No. WO2005/090427 and U.S. patent application Ser. No. 11/376,835 may be used as the base polymer. Such olefin block copolymer may be an ethylene/α-olefin interpolymer:

(a) having a Mw/Mn from about 1.7 to about 3.5, at least one melting point, Tm, in degrees Celsius, and a density, d, in grams/cubic centimeter, wherein the numerical values of Tm and d corresponding to the relationship:

$$Tm > -2002.9 + 4538.5(d) - 2422.2(d)^2; \text{ or}$$

(b) having a Mw/Mn from about 1.7 to about 3.5, and being characterized by a heat of fusion, ΔH in J/g, and a delta quantity, ΔT, in degrees Celsius defined as the temperature difference between the tallest DSC peak and the tallest CRY- STAF peak, wherein the numerical values of ΔT and ΔH having the following relationships:

$$\Delta T > -0.1299(\Delta H) + 62.81 \text{ for } \Delta H \text{ greater than zero and up to 130 J/g,}$$

$$\Delta T \geqq 48^\circ \text{ C. for } \Delta H \text{ greater than 130 J/g,}$$

wherein the CRYSTAF peak being determined using at least 5 percent of the cumulative polymer, and if less than 5 percent of the polymer having an identifiable CRYSTAF peak, then the CRYSTAF temperature being 30° C.; or (c) being characterized by an elastic recovery, Re, in percent at 300 percent strain and 1 cycle measured with a compression-molded film of the ethylene/α-olefin interpolymer, and having a density, d, in grams/cubic centimeter, wherein the numerical values of Re and d satisfying the following relationship when ethylene/α-olefin interpolymer being substantially free of a cross-linked phase:

$$Re > 1481 - 1629(d); \text{ or}$$

(d) having a molecular fraction which elutes between 40° C. and 130° C. when fractionated using TREF, characterized in that the fraction having a molar comonomer content of at least 5 percent higher than that of a comparable random ethylene interpolymer fraction eluting between the same temperatures, wherein said comparable random ethylene interpolymer having the same comonomer(s) and having a melt index, density, and molar comonomer content (based on the whole polymer) within 10 percent of that of the ethylene/α-olefin interpolymer; or (e) having a storage modulus at 25° C., G' (25° C.), and a storage modulus at 100° C., G' (100° C.), wherein the ratio of G' (25° C.) to G' (100° C.) being in the range of about 1:1 to about 9:1.

The ethylene/α-olefin interpolymer may also:

(a) having a molecular fraction which elutes between 40° C. and 130° C. when fractionated using TREF, characterized in that the fraction having a block index of at least 0.5 and up to about 1 and a molecular weight distribution, Mw/Mn, greater than about 1.3; or (b) having an average block index greater than zero and up to about 1.0 and a molecular weight distribution, Mw/Mn, greater than about 1.3.

In specific embodiments, polyolefins such as polypropylene, polyethylene, and copolymers thereof, and blends thereof, as well as ethylene-propylene-diene terpolymers, may be used. In some embodiments, preferred olefinic polymers include homogeneous polymers described in U.S. Pat. No. 3,645,992 issued to Elston; high density polyethylene (HDPE) as described in U.S. Pat. No. 4,076,698 issued to Anderson; heterogeneously branched linear low density polyethylene (LLDPE); heterogeneously branched ultra low linear density polyethylene (ULDPE); homogeneously branched, linear ethylene/alpha-olefin copolymers; homogeneously branched, substantially linear ethylene/alpha-olefin polymers, which can be prepared, for example, by a process disclosed in U.S. Pat. Nos. 5,272,236 and 5,278,272, the disclosures of which are incorporated herein by reference; and high pressure, free radical polymerized ethylene polymers and copolymers such as low density polyethylene (LDPE).

Polymer compositions described in U.S. Pat. Nos. 6,566,446, 6,538,070, 6,448,341, 6,316,549, 6,111,023, 5,869,575, 5,844,045, or 5,677,383, each of which is incorporated herein by reference in its entirety, are also suitable in some embodiments. Of course, blends of polymers can be used as well. In some embodiments, the blends include two different Ziegler-Natta polymers. In other embodiments, the blends can include blends of a Ziegler-Natta and a metallocene polymer. In still other embodiments, the polymer used herein is a blend of two different metallocene polymers. In other embodiments polymers produced from single site catalysts may be used. In yet another embodiment, block or multi-block copolymers may be used in embodiments of the invention. Such polymers include those described and claimed in WO2005/090427 (having priority to U.S. Ser. No. 60/553,906, filed Mar. 7, 2004).

In some particular embodiments, the polymer is a propylene-based copolymer or interpolymer. In some embodiments, the propylene/ethylene copolymer or interpolymer is characterized as having substantially isotactic propylene sequences. The term "substantially isotactic propylene sequences" and similar terms mean that the sequences have an isotactic triad (mm) measured by $^{13}$C NMR of greater than about 0.85, preferably greater than about 0.90, more preferably greater than about 0.92 and most preferably greater than about 0.93. Isotactic triads are well-known in the art and are described in, for example, U.S. Pat. No. 5,504,172 and WO 00/01745, which refer to the isotactic sequence in terms of a triad unit in the copolymer molecular chain determined by $^{13}$C NMR spectra.

In other particular embodiments, the base polymer may be ethylene vinyl acetate (EVA) based polymers. In other embodiments, the base polymer may be ethylene-methyl acrylate (EMA) based polymers. In other particular embodiments, the ethylene-alpha olefin copolymer may be ethylene-butene, ethylene-hexene, or ethylene-octene copolymers or interpolymers. In other particular embodiments, the propylene-alpha olefin copolymer may be a propylene-ethylene or a propylene-ethylene-butene copolymer or interpolymer.

In certain embodiments, the base polymer can be an ethylene-octene copolymer or interpolymer having a density between 0.863 and 0.911 g/cc and melt index (190° C. with 2.16 kg weight) from 0.1 to 100 g/10 min. In other embodiments, the ethylene-octene copolymers may have a density between 0.863 and 0.902 g/cc and melt index (190° C. with 2.16 kg weight) from 0.8 to 35 g/10 min.

In certain embodiments, the base polymer can be a propylene-ethylene copolymer or interpolymer having an ethylene content between 5 and 20% by weight and a melt flow rate 230° C. with 2.16 kg weight) from 0.5 to 300 g/10 min. In other embodiments, the propylene-ethylene copolymer or interpolymer may have an ethylene content between 9 and 12% by weight and a melt flow rate (230° C. with 2.16 kg weight) from 1 to 100 g/10 min.

In certain other embodiments, the base polymer can be a low density polyethylene having a density between 0.911 and 0.925 g/cc and melt index (190° C. with 2.16 kg weight) from 0.1 to 100 g/10 min.

In other embodiments, the base polymer can have a crystallinity of less than 50 percent. In preferred embodiments, the crystallinity of the base polymer may be from 5 to 35 percent. In more preferred embodiments, the crystallinity can range from 7 to 20 percent.

In certain other embodiments, the base polymer can have a melting point of less than 110° C. In preferred embodiments, the melting point may be from 25 to 100° C. In more preferred embodiments, the melting point may be between 40 and 85° C.

In certain embodiments, the base polymer can have a weight average molecular weight greater than 20,000 g/mole. In preferred embodiments, the weight average molecular weight may be from 20,000 to 150,000 g/mole; in more preferred embodiments, from 50,000 to 100,000 g/mole.

The one or more thermoplastic resins may be contained within the aqueous dispersion in an amount from about 1% by weight to about 96% by weight. For instance, the thermoplastic resin may be present in the aqueous dispersion in an amount from about 10% by weight to about 70% by weight, such as from about 20% to about 50% by weight.

Those having ordinary skill in the art will recognize that the above list is a non-comprehensive listing of suitable polymers. It will be appreciated that the scope of the present invention is restricted by the claims only.

Stabilizing Agent

Embodiments of the present invention use a stabilizing agent to promote the formation of a stable dispersion or emulsion. In selected embodiments, the stabilizing agent may be a surfactant, a polymer (different from the base polymer detailed above), or mixtures thereof. In certain embodiments, the polymer can be a polar polymer, having a polar group as either a comonomer or grafted monomer. In preferred embodiments, the stabilizing agent comprises one or more polar polyolefins, having a polar group as either a comonomer or grafted monomer. Typical polymers include ethylene-acrylic acid (EAA) and ethylene-methacrylic acid copolymers, such as those available under the trademarks PRIMACOR™ (trademark of The Dow Chemical Company), NUCREL™ (trademark of E.I. DuPont de Nemours), and ESCOR™ (trademark of ExxonMobil) and described in U.S. Pat. Nos. 4,599,392, 4,988,781, and 5,938,437, each of which is incorporated herein by reference in its entirety. Other polymers include ethylene ethyl acrylate (EEA) copolymer, ethylene methyl methacrylate (EMMA), and ethylene butyl acrylate (EBA). Other ethylene-carboxylic acid copolymer may also be used. Those having ordinary skill in the art will recognize that a number of other useful polymers may also be used.

Other surfactants that may be used include long chain fatty acids or fatty acid salts having from 12 to 60 carbon atoms. In other embodiments, the long chain fatty acid or fatty acid salt may have from 12 to 40 carbon atoms.

If the polar group of the polymer is acidic or basic in nature, the stabilizing polymer may be partially or fully neutralized with a neutralizing agent to form the corresponding salt. In certain embodiments, neutralization of the stabilizing agent, such as a long chain fatty acid or EAA, may be from 25 to 200% on a molar basis; from 50 to 110% on a molar basis in other embodiments. For example, for EAA, the neutralizing agent is a base, such as ammonium hydroxide or potassium hydroxide, for example. Other neutralizing agents can include lithium hydroxide or sodium hydroxide, for example. In another alternative, the neutralizing agent may, for example, be any amine such as monoethanolamine, or 2-amino-2-methyl-1-propanol (AMP). Those having ordinary skill in the art will appreciate that the selection of an appropriate neutralizing agent depends on the specific composition formulated, and that such a choice is within the knowledge of those of ordinary skill in the art.

Additional surfactants that may be useful in the practice of the present invention include cationic surfactants, anionic surfactants, or a non-ionic surfactants. Examples of anionic surfactants include sulfonates, carboxylates, and phosphates. Examples of cationic surfactants include quaternary amines. Examples of non-ionic surfactants include block copolymers containing ethylene oxide and silicone surfactants. Surfactants useful in the practice of the present invention can be either external surfactants or internal surfactants. External surfactants are surfactants that do not become chemically reacted into the polymer during dispersion preparation. Examples of external surfactants useful herein include salts of dodecyl benzene sulfonic acid and lauryl sulfonic acid salt. Internal surfactants are surfactants that do become chemically reacted into the polymer during dispersion preparation. An example of an internal surfactant useful herein includes 2,2-dimethylol propionic acid and its salts.

In particular embodiments, the dispersing agent or stabilizing agent may be used in an amount ranging from greater than zero to about 60% by weight based on the amount of base polymer (or base polymer mixture) used. For example, long chain fatty acids or salts thereof may be used from 0.5 to 10% by weight based on the amount of base polymer. In other embodiments, ethylene-acrylic acid or ethylene-methacrylic acid copolymers may be used in an amount from 0.5 to 60% by weight based on polymer. In yet other embodiments, sulfonic acid salts may be used in an amount from 0.5 to 10% by weight based on the amount of base polymer.

The type and amount of stabilizing agent used can also affect end properties of the cellulose-based article formed incorporating the dispersion. For example, articles having improved oil and grease resistance might incorporate a surfactant package having ethylene-acrylic acid copolymers or ethylene-methacrylic acid copolymers in an amount from about 10 to about 50% by weight based on the total amount of base polymer. A similar surfactant package may be used when improved strength or softness is a desired end property. As another example, articles having improved water or moisture resistance might incorporate a surfactant package utilizing long chain fatty acids in an amount from 0.5 to 5%, or ethylene-acrylic acid copolymers in an amount from 10 to 50%, both by weight based on the total amount of base polymer. In other embodiments, the minimum amount of surfactant or stabilizing agent must be at least 1% by weight based on the total amount of base polymer.

Fillers

Embodiments of the present invention employ a filler as part of the composition. In the practice of the present invention, a suitable filler loading in a polyolefin dispersion can be from about 0 to about 600 parts of filler per hundred parts of polyolefin. In certain embodiments, the filler loading in the dispersion can be from about 0 to about 200 parts of filler per hundred parts of a combined amount of the polyolefin and the polymeric stabilizing agent. The filler material can include conventional fillers such as milled glass, calcium carbonate, aluminum trihydrate, talc, antimony trioxide, fly ash, clays (such as bentonite or kaolin clays for example), or other known fillers.

Dispersion Formulations

In preferred formulations, therefore, dispersions in accordance with the present invention may include a base polymer, which may comprise at least one non-polar polyolefin, a stabilizing agent, which may comprise at least one polar polyolefin, and optionally a filler. With respect to the base polymer and the stabilizing agent, in preferred embodiments, the at least one non-polar polyolefin may comprise between about 30% to 99% (by weight) of the total amount of base polymer and stabilizing agent in the composition. More preferably, the at least one non-polar polyolefin comprises between about 50% and about 80%. Still more preferably, the one or more non-polar polyolefins comprise about 70%.

With respect to the filler, typically, an amount greater than about 0 to about 1000 parts per hundred of the polymer (polymer meaning here the non-polar polyolefin combined with the stabilizing agent) is used. In selected embodiments, between about 50 to 250 parts per hundred are used. In selected embodiments, between about 10 to 500 parts per hundred are used. In still other embodiments, from between about 20 to 400 parts per hundred are used. In other embodiments, from about 0 to about 200 parts per hundred are used.

These solid materials are preferably dispersed in a liquid medium, which in preferred embodiments is water. In preferred embodiments, sufficient neutralization agent is added to neutralize the resultant dispersion to achieve a pH range of between about 4 to about 14. In preferred embodiments, sufficient base is added to maintain a pH of between about 6 to about 11; in other embodiments, the pH may be between about 8 to about 10.5. Water content of the dispersion is preferably controlled so that the solids content (base polymer plus stabilizing agent) is between about 1% to about 74% by volume. In another embodiment, the solid content is between about 25% to about 74% by volume. In particular embodiments, the solids range may be between about 10% to about 70% by weight. In other particular embodiments, the solids range is between about 20% to about 60% by weight. In particularly preferred embodiments, the solids range is between about 30% to about 55% by weight.

In certain embodiments, a fibrous structure with a compound can have a combined amount of the at least one polymer and the polymeric stabilizing agent in the range of about 10 to about 150 parts per hundred parts by weight of the textile. In other embodiments, a fibrous structure with a compound can have a combined amount of the filler, the at least one polymer and the polymeric stabilizing agent in the range of about 10 to about 600 parts per hundred parts by weight of the textile; from about 10 to about 300 parts in other embodiments.

Dispersions formed in accordance with embodiments of the present invention are characterized in having an average particle size of between about 0.1 to about 5.0 microns. In other embodiments, dispersions have an average particle size of from about 0.5 μm to about 2.7 μm. In other embodiments, from about 0.8 μm to about 1.2 μm. By "average particle size", the present invention means the volume-mean particle size. In order to measure the particle size, laser-diffraction techniques may be employed for example. A particle size in this description refers to the diameter of the polymer in the dispersion. For polymer particles that are not spherical, the diameter of the particle is the average of the long and short axes of the particle. Particle sizes can be measured on a Beckman-Coulter LS230 laser-diffraction particle size analyzer or other suitable device.

For example, a formulation of the present invention can include surfactants, frothing agents, dispersants, thickeners, fire retardants, pigments, antistatic agents, reinforcing fibers, antifoam agent, anti block, wax-dispersion, antioxidants, a neutralizing agent, a rheology modifier, preservatives, biocides, acid scavengers, a wetting agent, and the like. While optional for purposes of the present invention, other components can be highly advantageous for product stability during and after the manufacturing process.

In addition, embodiments of the present invention optionally include a filler wetting agent. A filler wetting agent generally may help make the filler and the polyolefin dispersion more compatible. Useful wetting agents include phosphate salts, such as sodium hexametaphosphate. A filler wetting agent can be included in a composition of the present invention at a concentration of at least about 0.5 parts per 100 parts of filler, by weight.

Furthermore, embodiments of the present invention may optionally include a thickener. Thickeners can be useful in the present invention to increase the viscosity of low viscosity dispersions. Thickeners suitable for use in the practice of the present invention can be any known in the art such as for instance poly-acrylate type or associate non ionic thickeners such as modified cellulose ethers. For example, suitable thickeners include ALCOGUM™ VEP-II (trademark of Alco Chemical Corporation), RHEOVIS™ and VISCALEX™ (trademarks of Ciba Ceigy), UCAR® Thickener 146, or ETHOCEL™ or METHOCEL™ (trademarks of the The Dow Chemical Company) and PARAGUM™ 241 (trademarks of Para-Chem Southern, Inc.), or BERMACOL™ (trademark of Akzo Nobel) or AQUALON™ (trademark of Hercules) or ACUSOL® (trademark of Rohm and Haas). Thickeners can be used in any amount necessary to prepare a dispersion of desired viscosity.

The ultimate viscosity of the dispersion is, therefore, controllable. Addition of the thickener to the dispersion including the amount of filler can be done with conventional means to result in viscosities as needed. Viscosities of thus dispersions can reach +3000 cP (Brookfield spindle 4 with 20 rpm) with moderate thickener dosing (up to 4% preferably, below 3% based on 100 phr of polymer dispersion). The starting polymer dispersion as described has an initial viscosity prior to formulation with fillers and additives between 20 and 1000 cP (Brookfield viscosity measured at room temperature with spindle RV3 at 50 rpm). Still more preferably, the starting viscosity of the dispersion may be between about 100 to about 600 cP.

Also, embodiments of the present invention are characterized by their stability when a filler is added to the polymer/stabilizing agent. In this context, stability refers to the stability of viscosity of the resultant aqueous polyolefin dispersion. In order to test the stability, the viscosity is measured over a period of time. Preferably, viscosity measured at 20° C. should remain +/−10% of the original viscosity over a period of 24 hours, when stored at ambient temperature.

The aqueous dispersion of the present invention may contain particles having an average particle size of from about 0.1 to about 5 microns. The coatings obtained therefrom exhibit excellent moisture resistance, water repellency, oil and grease resistance, thermal adhesion to paper and other natural and synthetic substrates such as metal, wood, glass, synthetic fibers and films, and woven and non-woven fabrics.

Aqueous dispersion of the present invention may be used for such applications as a binder of a coating or ink composition for a coated paper, paper-board, wall-paper, or other cellulose based article. The aqueous dispersion may be coated by various techniques, for example, by spray coating, curtain coating, coating with a roll coater or a gravure coater, brush coating, or dipping. The coating is preferably dried by heating the coated substrate to 70-150° C. for 1 to 300 sec.

Examples of aqueous dispersions that may be incorporated into the additive composition of the present disclosure are disclosed, for instance, in U.S. Patent Application Publication No. 2005/0100754, U.S. Patent Application Publication No. 2005/0192365, PCT Publication No. WO 2005/021638, and PCT Publication No. WO 2005/021622, which are all incorporated herein by reference.

Additives

Additives can be used with the base polymer, stabilizing agent, or filler used in the dispersion without deviating from the scope of the present invention. For example, additives may include a wetting agent, surfactants, anti-static agents, antifoam agent, anti block, wax-dispersion pigments, a neutralizing agent, a thickener, a compatibilizer, a brightener, a rheology modifier, a biocide, a fungicide, and other additives known to those skilled in the art.

Forming the Dispersion

The dispersions of the present invention can be formed by any number of methods recognized by those having skill in the art. In selected embodiments, the dispersions may be formed by using techniques disclosed for example, in the dispersions were formed in accordance with the procedures as described in WO2005021638, which is incorporated by reference in its entirety.

In a specific embodiment, a base polymer, a stabilizing agent, and a filler are melt-kneaded in an extruder along with water and a neutralizing agent, such as ammonia, potassium hydroxide, or a combination of the two to form a dispersion compound. Those having ordinary skill in the art will recognize that a number of other neutralizing agents may be used. In some embodiments, the filler may be added after blending the base polymer and stabilizing agent. In some embodiments, the dispersion is first diluted to contain about 1 to about 3% by weight water and then, subsequently, further diluted to comprise greater than about 25% by weight water.

Any melt-kneading means known in the art may be used. In some embodiments, a kneader, a BANBURY® mixer, single-screw extruder, or a multi-screw extruder is used. A process for producing the dispersions in accordance with the present invention is not particularly limited. One preferred process, for example, is a process comprising melt-kneading the above-mentioned components according to U.S. Pat. Nos. 5,756,659 and 6,455,636.

FIG. 1 schematically illustrates an extrusion apparatus that may be used in embodiments of the invention. An extruder 1, in certain embodiments a twin screw extruder, is coupled to a back pressure regulator, melt pump, or gear pump 2.

Embodiments also provide a base reservoir 3 and an initial water reservoir 4, each of which includes a pump (not shown). Desired amounts of base and initial water are provided from the base reservoir 3 and the initial water reservoir 4, respectively. Any suitable pump may be used, but in some embodiments a pump that provides a flow of about 150 cc/min at a pressure of 240 bar is used to provide the base and the initial water to the extruder 20. In other embodiments, a liquid injection pump provides a flow of 300 cc/min at 200 bar or 600 cc/min at 133 bar. In some embodiments, the base and initial water are preheated in a preheater.

Resin, in the form of pellets, powder, or flakes, is fed from the feeder 7 to an inlet 8 of the extruder 1 where the resin is melted or compounded. In some embodiments, the dispersing agent is added to the resin through and along with the resin and in other embodiments, the dispersing agent is provided separately to the twin screw extruder 1. The resin melt is then delivered from the mix and convey zone to an emulsification zone of the extruder where the initial amount of water and base from the reservoirs 3 and 4 is added through inlet 5. In some embodiments, dispersing agent may be added additionally or exclusively to the water stream. In some embodiments, the emulsified mixture is further diluted with additional water inlet 9 from reservoir 6 in a dilution and cooling zone of the extruder 1. Typically, the dispersion is diluted to at least 30 weight percent water in the cooling zone. In addition, the diluted mixture may be diluted any number of times until the desired dilution level is achieved. In some embodiments, water is not added into the twin screw extruder 1 but rather to a stream containing the resin melt after the melt has exited from the extruder. In this manner, steam pressure build-up in the extruder 20 is eliminated.

In particular embodiments, it may be desired to utilize the dispersion in the form of foam. When preparing foams, it is often preferred to froth the dispersion. Preferred in the practice of this invention is the use of a gas as a frothing agent. Examples of suitable frothing agents include: gases and/or mixtures of gases such as, air, carbon dioxide, nitrogen, argon, helium, and the like. Particularly preferable is the use of air as a frothing agent. Frothing agents are typically introduced by mechanical introduction of a gas into a liquid to form a froth. This technique is known as mechanical frothing. In preparing a frothed dispersion, it is preferred to mix all components and then blend the air or gas into the mixture, using equipment such as an OAKES, MONDO, or FIRESTONE frother.

Surfactants useful for preparing a stable froth are referred to herein as foam stabilizers. Foam stabilizers are useful in the practice of the present invention. Those having ordinary skill in this field will recognize that a number of foam stabilizers may be used. Foam stabilizers can include, for example, sulfates, succinamates, and sulfosuccinamates.

Advantageously, polyolefin dispersions formed in accordance with the embodiments disclosed herein provide the ability to incorporate the dispersion on or into cellulose-based compositions, including paper and paper-board, among others, as described in more detail below.

Cellulose-Based Compositions

Embodiments disclosed herein relate to cellulose-based compositions, which are generally referred to as "paper and/or paperboard products" (i.e., other than paper towels), such as newsprint, uncoated groundwood, coated groundwood, coated free sheet, uncoated free sheet, packaging and industrial papers, linerboard, corrugating medium, recycled paperboard, bleached paperboard, writing paper, typing paper, photo quality paper, wallpaper, etc. Such compositions can generally be formed in accordance with the present invention from at least one paper web. For example, in one embodiment, the paper product can contain a single-layered paper web formed from a blend of fibers. In another embodiment, the paper product can contain a multi-layered paper (i.e., stratified) web. Furthermore, the paper product can also be a single- or multi-ply product (e.g., more than one paper web), wherein one or more of the plies may contain a paper web formed according to the present invention. Normally, the basis weight of a paper product of the present invention is between about 10 to about 525 grams per square meter (gsm). Normally, the specific volume of a paper product in accordance with embodiments of the present invention is between about 0.3 to about 2 grams per cubic centimeter (g/cc).

Any of a variety of materials can be used to form the paper products of the present invention. For example, the material used to make paper products can include fibers formed by a variety of pulping processes, such as kraft pulp, sulfite pulp, thermomechanical pulp, etc.

Papermaking fibers useful in the process of the present invention include any cellulosic fibers that are known to be useful for making cellulosic base sheets. Suitable fibers include virgin softwood and hardwood fibers along with nonwoody fibers, as well as secondary (i.e., recycled) papermaking fibers and mixtures thereof in all proportions. Non-cellulosic synthetic fibers can also be included in the aqueous suspension. Papermaking fibers may be derived from wood using any known pulping process, including kraft and sulfite chemical pulps.

Fibers suitable for making paper webs comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898, issued Dec. 27, 1988 to Laamanen et al.; U.S. Pat. No. 4,594,130, issued Jun. 10, 1986 to Chang et al.; and U.S. Pat. No. 3,585,104. Useful fibers can also be produced by anthraquinone pulping, exemplified by U.S. Pat. No. 5,595,628 issued Jan. 21, 1997, to Gordon et al.

In one embodiment, a portion of the fibers, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is PULPEX®, available from Hercules, Inc. (Wilmington, Del.). Any known bleaching method can be used. Synthetic cellulose fiber types include rayon in all its varieties and other fibers derived from viscose or chemically-modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500. In some other embodiments, portions of the fibers up to about 90% by dry weight may be synthetic fibers.

Other papermaking fibers that can be used in the present disclosure include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

In some embodiments, the pulp fibers may include softwood fibers having an average fiber length of greater than 1 mm and particularly from about 2 to 5 mm based on a length-weighted average. Such softwood fibers can include, but are not limited to, northern softwood, southern softwood, redwood, red cedar, hemlock, pine (e.g., southern pines), spruce (e.g., black spruce), combinations thereof, and the like. Exemplary commercially available pulp fibers suitable for the present invention include those available from Neenah Paper Inc. under the trade designations "LONGLAC-19".

In some embodiments, hardwood fibers, such as eucalyptus, maple, birch, aspen, and the like, can also be used. In certain instances, eucalyptus fibers may be particularly desired to increase the softness of the web. Eucalyptus fibers can also enhance the brightness, increase the opacity, and change the pore structure of the paper to increase the wicking ability of the paper web. Moreover, if desired, secondary fibers obtained from recycled materials may be used, such as fiber pulp from sources such as, for example, newsprint, reclaimed paperboard, and office waste. Further, other natural fibers can also be used in the present invention, such as abaca, sabai grass, milkweed floss, pineapple leaf, and the like. In addition, in some instances, synthetic fibers can also be utilized. Some suitable synthetic fibers can include, but are not limited to, rayon fibers, ethylene vinyl alcohol copolymer fibers, polyolefin fibers, polyesters, and the like.

As stated, the paper product of the present invention can be formed from one or more paper webs. The paper webs can be single-layered or multi-layered. For instance, in one embodiment, the paper product contains a single-layered paper web layer that is formed from a blend of fibers. For example, in some instances, eucalyptus and softwood fibers can be homogeneously blended to form the single-layered paper web.

In another embodiment, the paper product can contain a multi-layered paper web that is formed from a stratified pulp furnish having various principal layers. For example, in one embodiment, the paper product contains three layers where one of the outer layers includes eucalyptus fibers, while the other two layers include northern softwood kraft fibers. In another embodiment, one outer layer and the inner layer can contain eucalyptus fibers, while the remaining outer layer can contain northern softwood kraft fibers. If desired, the three principle layers may also include blends of various types of fibers. For example, in one embodiment, one of the outer layers can contain a blend of eucalyptus fibers and northern softwood kraft fibers. However, it should be understood that the multi-layered paper web can include any number of layers and can be made from various types of fibers. For instance, in one embodiment, the multi-layered paper web can be formed from a stratified pulp furnish having only two principal layers.

In accordance with the present invention, various properties of a paper product such as described above, can be optimized. For instance, strength (e.g., wet tensile, dry tensile, tear, etc.), softness, lint level, slough level, and the like, are some examples of properties of the paper product that may be optimized in accordance with the present invention. However, it should be understood that each of the properties mentioned above need not be optimized in every instance. For example, in certain applications, it may be desired to form a paper product that has increased strength without regard to softness.

In this regard, in one embodiment of the present invention, at least a portion of the fibers of the paper product can be treated with hydrolytic enzymes to increase strength and reduce lint. In particular, the hydrolytic enzymes can randomly react with the cellulose chains at or near the surface of the papermaking fibers to create single aldehyde groups on the fiber surface which are part of the fiber. These aldehyde groups become sites for cross-linking with exposed hydroxyl groups of other fibers when the fibers are formed and dried into sheets, thus increasing sheet strength. In addition, by randomly cutting or hydrolyzing the fiber cellulose predominantly at or near the surface of the fiber, degradation of the interior of the fiber cell wall is avoided or minimized. Consequently, a paper product made from these fibers alone, or made from blends of these fibers with untreated pulp fibers, show an increase in strength properties such as dry tensile, wet tensile, tear, etc.

Other examples of useful cellulose-based compositions useful in the present invention include those disclosed in U.S. Pat. Nos. 6,837,970, 6,824,650, 6,863,940 and in U.S. Patent Application Nos. US20050192402 and 20040149412 each of which is incorporated herein by reference. Cellulosic webs prepared in accordance with the present invention can be used for a wide variety of applications, such as paper and paperboard products (i.e., other than paper towels), newsprint, uncoated groundwood, coated groundwood, coated free sheet, uncoated free sheet, packaging and industrial papers, linerboard, corrugating medium, recycled paperboard, and bleached paperboard. Webs made according to the present invention can be used in diapers, sanitary napkins, composite materials, molded paper products, paper cups, paper plates, and the like. Materials prepared according to the present invention can also be used in various textile applications, particularly in textile webs comprising a blend of cellulosic materials and wool, nylon, silk or other polyamide or protein-based fibers.

The paper products may contain a variety of fiber types both natural and synthetic. In one embodiment the paper products comprises hardwood and softwood fibers. The overall ratio of hardwood pulp fibers to softwood pulp fibers within the product, including individual sheets making up the product may vary broadly. The ratio of hardwood pulp fibers to softwood pulp fibers may range from about 9:1 to about 1:9, more specifically from about 9:1 to about 1:4, and most specifically from about 9:1 to about 1:1. In one embodiment of the present invention, the hardwood pulp fibers and softwood pulp fibers may be blended prior to forming the paper sheet thereby producing a homogenous distribution of hardwood pulp fibers and softwood pulp fibers in the z-direction of the sheet. In another embodiment of the present invention, the hardwood pulp fibers and softwood pulp fibers may be layered so as to give a heterogeneous distribution of hardwood pulp fibers and softwood pulp fibers in the z-direction of the sheet. In another embodiment, the hardwood pulp fibers may be located in at least one of the outer layers of the paper product and/or sheets wherein at least one of the inner layers may comprise softwood pulp fibers. In still another embodiment the paper product contains secondary or recycled fibers optionally containing virgin or synthetic fibers.

In addition, synthetic fibers may also be utilized in the present invention. The discussion herein regarding pulp fibers is understood to include synthetic fibers. Some suitable polymers that may be used to form the synthetic fibers include, but are not limited to: polyolefins, such as, polyethylene, polypropylene, polybutylene, and the like; polyesters, such as polyethylene terephthalate, poly(glycolic acid) (PGA), poly (lactic acid) (PLA), poly(β-malic acid) (PMLA), poly(ϵ-caprolactone) (PCL), poly(ρ-dioxanone) (PDS), poly(3-hydroxybutyrate) (PHB), and the like; and, polyamides, such as nylon and the like. Synthetic or natural cellulosic polymers, including but not limited to: cellulosic esters; cellulosic ethers; cellulosic nitrates; cellulosic acetates; cellulosic acetate butyrates; ethyl cellulose; regenerated celluloses, such as viscose, rayon, and the like; cotton; flax; hemp; and mixtures thereof may be used in the present invention. The synthetic fibers may be located in one or all of the layers and sheets comprising the or paper product.

Cellulose-based articles can be formed by a variety of processes known to those skilled in the art. Machines may be configured to have a forming section, a press section, a drying section, and depending on the article formed, optionally a reel. Examples of the details of the process steps and schematic illustrations may be found in "Properties of Paper: An Introduction" 2nd edition W. Scott an J. Abbott, TAPPI Press 1995. In a simplified description of the process, typically a dilute suspension of pulp fibers is supplied by a head-box and deposited via a sluice in a uniform dispersion onto a forming fabric of a conventional papermaking machine. The suspension of pulp fibers may be diluted to any consistency which is typically used in conventional papermaking processes. For example, the suspension may contain from about 0.01 to about 1.5 percent by weight pulp fibers suspended in water. Water is removed from the suspension of pulp fibers to form a uniform layer of pulp fibers. Other paper-making processes, paper-board manufacturing processes, and the like, may be utilized with the present invention. For example, the processes disclosed in U.S. Pat. No. 6,423,183 may be used.

The pulp fibers may be any high-average fiber length pulp, low-average fiber length pulp, or mixtures of the same. The high-average fiber length pulp typically have an average fiber length from about 1.5 mm to about 6 mm. An exemplary high-average fiber length wood pulp includes one available from the Neenah Paper Inc. under the trade designation LONGLAC 19.

The low-average fiber length pulp may be, for example, certain virgin hardwood pulps and secondary (i.e. recycled) fiber pulp from sources such as, for example, newsprint, reclaimed paperboard, and office waste. The low-average fiber length pulps typically have an average fiber length of less than about 1.2 mm, for example, from 0.7 mm to 1.2 mm.

Mixtures of high-average fiber length and low-average fiber length pulps may contain a significant proportion of low-average fiber length pulps. For example, mixtures may contain more than about 50 percent by weight low-average fiber length pulp and less than about 50 percent by weight high-average fiber length pulp. One exemplary mixture contains 75 percent by weight low-average fiber length pulp and about 25 percent high-average fiber length pulp.

The pulp fibers used in the present invention may be unrefined or may be beaten to various degrees of refinement. Small amounts of wet-strength resins and/or resin binders may be added to improve strength and abrasion resistance. Useful binders and wet-strength resins include, for example, KYMENE 557 H available from the Hercules Chemical Company and PAREZ 631 available from American Cyanamid, Inc. Cross-linking agents and/or hydrating agents may also be added to the pulp mixture. Debonding agents may be added to the pulp mixture to reduce the degree of hydrogen bonding if a very open or loose nonwoven pulp fiber web is desired. One exemplary debonding agent is available from the Quaker Chemical Company, Conshohocken, Pa., under the trade designation QUAKER 2008. The addition of certain debonding agents in the amount of, for example, 1 to 4 percent, by weight, of the composite also appears to reduce the measured static and dynamic coefficients of friction and improve the abrasion resistance of the continuous filament rich side of the composite fabric. The de-bonder is believed to act as a lubricant or friction reducer.

Dispersion Incorporation

When treating paper webs in accordance with the present disclosure, the additive composition containing the aqueous polymer dispersion can be applied to the web topically or can be incorporated into the web by being pre-mixed with the fibers that are used to form the web. When applied topically, the additive composition can be applied to the web when the web is wet or dry. In one embodiment, the additive composition may be applied topically to the web during a creping process. For instance, in one embodiment, the additive composition may be sprayed onto the web or onto a heated dryer drum to adhere the web to the dryer drum. The web can then be creped from the dryer drum. When the additive composition is applied to the web and then adhered to the dryer drum, the composition may be uniformly applied over the surface area of the web or may be applied according to a particular pattern.

When topically applied to a paper web, the additive composition may be sprayed onto the web, extruded onto the web, or printed onto the web. When extruded onto the web, any suitable extrusion device may be used, such as a slot-coat extruder or a meltblown dye extruder. When printed onto the web, any suitable printing device may be used. For example, an inkjet printer or a rotogravure printing device may be used.

The dispersion may be incorporated at any point in the paper manufacturing process. The point during the process at which the dispersion is incorporated into the cellulose-based composition may depend upon the desired end properties of the cellulose-based product, as will be detailed later. Incorporation points may include pre-treatment of pulp, co-application in the wet end of the process, post treatment after drying but on the paper machine and topical post treatment. Incorporation of the dispersion of the present invention onto or in the cellulose-based structure may be achieved by any of several methods, as illustrated by the following non-limiting descriptions.

For example, in some embodiments, adhesion to the paper web of the dispersion compound in the form of a drum drying additive present between the paper web and a dryer drum surface, wherein a portion of the compound remains with the paper web when the paper web is separated from the dryer drum by peeling, pulling, action of an air knife, or any other means known in the art.

In other embodiments, direct addition of the dispersion to a fibrous slurry, such as by injection of the compound into a slurry prior to entry in the headbox. Slurry consistency can be from about 0.2% to about 50%, specifically from about 0.2% to about 10%, more specifically from about 0.3% to about 5%, and most specifically from about 1% to about 4%. When combined at the wet end with the aqueous suspension of fibers, a retention aid may also be present within the dispersion compound or additive composition. For instance, in one particular embodiment, the retention aid may comprise polydiallyl dimethyl ammonium chloride. The additive composition may be incorporated into the paper web in an amount from about 0.01% to about 30% by weight, such as from about 0.5% to about 20% by weight. For instance, in one embodiment, the additive composition may be present in an amount up to about 10% by weight. The above percentages are based upon the solids that are added to the paper web.

In other embodiments, a dispersion spray can be applied to a paper web. For example, spray nozzles may be mounted over a moving web to apply a desired dose of a solution to the web that may be moist or substantially dry. Nebulizers may also be used to apply a light mist to a surface of a web.

In other embodiments, the dispersion can be printed onto a paper web, such as by offset printing, gravure printing, flexographic printing, ink jet printing, digital printing of any kind, and the like.

In other embodiments, the dispersion can be coated onto one or both surfaces of a paper web, such as blade coating, air knife coating, short dwell coating, cast coating, and the like.

In other embodiments, the dispersion can be extruded onto the surface of a paper web. For example, extrusion of a dispersion is disclosed in PCT publication, WO 2001/12414, published on Feb. 22, 2001, herein incorporated by reference to the extent that it is non-contradictory herewith.

In other embodiments, the dispersion can be applied to individualized fibers. For example, comminuted or flash dried fibers may be entrained in an air stream combined with an aerosol or spray of the compound to treat individual fibers prior to incorporation into a paper web or other fibrous product.

In other embodiment, the dispersion may be heated prior to or during application to a paper web. Heating the composition can lower the viscosity for facilitating application. For instance, the additive composition may be heated to a temperature of from about 50° C. to about 150° C.

In other embodiments, a wet or dry paper web can be impregnated with a solution or slurry, wherein the dispersion penetrates a significant distance into the thickness of the web, such as at least about 20% of the thickness of the web, more specifically at least about 30% and most specifically at least about 70% of the thickness of the web, including completely penetrating the web throughout the full extent of its thickness. One useful method for impregnation of a moist paper web is the HYDRA-SIZER® system, produced by Black Clawson Corp., Watertown, N.Y., as described in "New Technology to Apply Starch and Other Additives," *Pulp and Paper Canada*, 100(2): T42-T44 (February 1999). This system consists of a die, an adjustable support structure, a catch pan, and an additive supply system. A thin curtain of descending liquid or slurry is created which contacts the moving web beneath it. Wide ranges of applied doses of the coating material are said to be achievable with good run-ability. The system can also be applied to curtain coat a relatively dry web In other embodiments, the dispersion can be applied to a fibrous web using a foam application (e.g., foam finishing), either for topical application or for impregnation of the dispersion compound into the web under the influence of a pressure differential (e.g., vacuum-assisted impregnation of the foam). Principles of foam application of additives such as binder agents are described in U.S. Pat. No. 4,297,860, "Device for Applying Foam to Textiles," issued on Nov. 3, 1981 to Pacifici et al.; and, U.S. Pat. No. 4,773,110, "Foam Finishing Apparatus and Method," issued on Sep. 27, 1988 to G. J. Hopkins, both of which are herein incorporated by reference to the extent that they are non-contradictory herewith.

In still other embodiments, the dispersion can be applied by padding of a solution of the dispersion compound into an existing fibrous web. Roller fluid feeding of the dispersion compound for application to the paper web may also be used.

In other embodiments, application of the dispersion compound by spray or other means to a moving belt or fabric which in turn contacts the paper web to apply the chemical to the web, such as is disclosed in PCT publication, WO 01/49937 by S. Eichhorn, "A Method of Applying Treatment Chemicals to a Fiber-Based Planar Product Via a Revolving Belt and Planar Products Made Using Said Method," published on Jun. 12, 2001.

Topical application of the dispersion to a paper web may occur prior to drum drying in the process described above. In addition to applying the dispersion during formation of the paper web, the dispersion may also be used in post-forming processes. For example, in one embodiment, the dispersion may be used during a printing process. Specifically, once topically applied to a either side of a paper web, the dispersion may adhering to the paper web. For example, once a paper web is formed and dried, in one embodiment, the dispersion may be applied to at least one side of the web. In general, the dispersion may be applied to only one side of the web, or the dispersion may be applied to each side of the web.

Before the dispersion compound is applied to an existing paper web, the solids level of the web may be about 10% or higher (i.e., the web comprises about 10 grams of dry solids and 90 grams of water, such as about any of the following solids levels or higher: 12%, 15%, 18%, 20%, 25%, 30%, 35%, 40%, 45%, 50%, 60%, 75%, 80%, 90%, 95%, 98%, and 99%, with exemplary ranges of from about 30% to about 100% and more specifically from about 65% to about 90%).

The solids level of the web immediately after application of any of the dispersion may also be any of the previously mentioned solids levels.

The preferred coating weight of the polyolefin ranges from about 2.5 to 300 kg polyolefin per metric ton (about 5 to about 600 lb of polymer per ton) of cellulose article. More preferred coating weight of the polyolefin ranges from about 5 to about 150 kg per metric ton (about 10 to about 300 lb of polymer per ton) of cellulose article. Most preferred thickness for the dried coating ranges from about 10 to about 100 kg polyolefin per metric ton (20 to 200 lb per ton).

In certain embodiments, the incorporation can result in an article having a base polymer coating weight of less than 15 $g/m^2$. In other embodiments, the incorporation can result in an article having a base polymer coating weight between about 1.0 and about 10 $g/m^2$; in preferred embodiments, between about 1.0 and 5.0 $g/m^2$.

In other embodiments, the incorporation can result in a polymer or compound layer having a thickness between about 0.1 and about 100 microns; in other embodiments, the layer can be between about 1.0 and about 15 microns; in preferred embodiments between about 1.0 and about 10 microns; between about 1.0 microns and about 5.0 microns in more preferred embodiments.

Once a paper web is produced according to one of the above described processes incorporating the dispersion or additive composition, in accordance with the present disclosure, the web can be embossed, crimped, and/or laminated with other webs by applying pressure and/or heat to the web containing the dispersion. During the process, the additive composition can form embossments in the product and/or can form bond areas for bonding the paper web to other adjacent webs. Use of the additive composition enhances the embossing, crimping or lamination process in several ways. For instance, the embossed pattern can be much more defined due to the presence of the additive composition. Further, the embossing is not only water resistant but, unexpectedly, it has been discovered that a paper web containing the additive composition can be embossed without substantially weakening the web. In particular, it has been discovered that a paper web containing the additive composition can be embossed without reducing the tensile strength of the web in either the machine direction or the cross machine direction by more than about 5%. In fact, in some embodiments, the tensile strength of the web may actually be increased after the embossing process.

When forming multiple ply products, the resulting paper product may comprise two plies, three plies, or more. Each adjacent ply may contain the additive composition or at least one of the plies adjacent to one another may contain the additive composition. The individual plies can generally be made from the same or from a different fiber furnish and can be made from the same or a different process.

In other embodiments, the dispersion may be applied after a paper product has been manufactured. That is, a dispersion formed in accordance with embodiments of the present invention may be added to a prior formed by product, as by a paper converter for example. Embodiments of the present invention may be used in an "in-line process," that is during the manufacturing of the paper, or in an off-line application. One example is where paper is previously clay-coated on a machine. Then, that product may have the dispersion applied as an alternative to an extrusion coated structures.

Drying the Incorporated Dispersion

The dispersion incorporated into, for example, the cellulose-based composition, as described hereinabove, may be dried via any conventional drying method. Such conventional drying methods include but, are not limited to, air drying, convection oven drying, hot air drying, microwave oven drying, and/or infrared oven drying. The dispersion incorporated into, for example, a cellulose-based composition may be dried at any temperature; for example, it may be dried at a temperature in the range of equal or greater than the melting point temperature of the base polymer; or in the alternative, it may be dried at a temperature in the range of less than the melting point of the base polymer. The dispersion incorporated into, for example, a cellulose-based composition may be dried at a temperature in the range of about 60° F. (15.5° C.) to about 700° F. (371° C.). All individual values and subranges from about 60° F. (15.5° C.) to about 700° F. (371° C.) are included herein and disclosed herein; for example, the dispersion incorporated into, for example, a cellulose-based composition may be dried at a temperature in the range of about 60° F. (15.5° C.) to about 500° F. (260° C.), or in the alternative, the dispersion incorporated into, for example, a cellulose-based composition may be dried at a temperature in the range of about 60° F. (15.5° C.) to about 450° F. (232.2° C.). The temperature of the dispersion incorporated into, for example, a cellulose-based composition may be raised to a temperature in the range of equal or greater than the melting point temperature of the base polymer for a period of less than about 40 minutes. All individual values and subranges from less than about 40 minutes are included herein and disclosed herein; for example, the temperature of the dispersion incorporated into, for example, a cellulose-based composition may be raised to a temperature in the range of equal or greater than the melting point temperature of the base polymer for a period of less than about 20 minutes, or in the alternative, the temperature of the dispersion incorporated into, for example, a cellulose-based composition may be raised to a temperature in the range of equal or greater than the melting point temperature of the base polymer for a period of less than about 5 minutes, or in another alternative, the temperature of the dispersion incorporated into, for example, a cellulose-based composition may be raised to a temperature in the range of equal or greater than the melting point temperature of the base polymer for a period in the range of about 0.5 to 300 seconds. In another alternative, the temperature of the dispersion incorporated into, for example, a cellulose-based composition may be raised to a temperature in the range of less than the melting point temperature of the base polymer for a period of less than 40 minutes. All individual values and subranges from less than about 40 minutes are included herein and disclosed herein; for example, the temperature of the dispersion incorporated into, for example, a cellulose-based composition may be raised to a temperature in the range of less than the melting point temperature of the base polymer for a period of less than about 20 minutes, or in the alternative, the temperature of the dispersion incorporated into, for example, a cellulose-based composition may be raised to a temperature in the range of less than the melting point temperature of the base polymer for a period of less than about 5 minutes, or in another alternative, the temperature of the dispersion incorporated into, for example, a cellulose-based composition may be raised to a temperature in the range of less than the melting point temperature of the base polymer for a period in the range of about 0.5 to 300 seconds.

Figure 4:
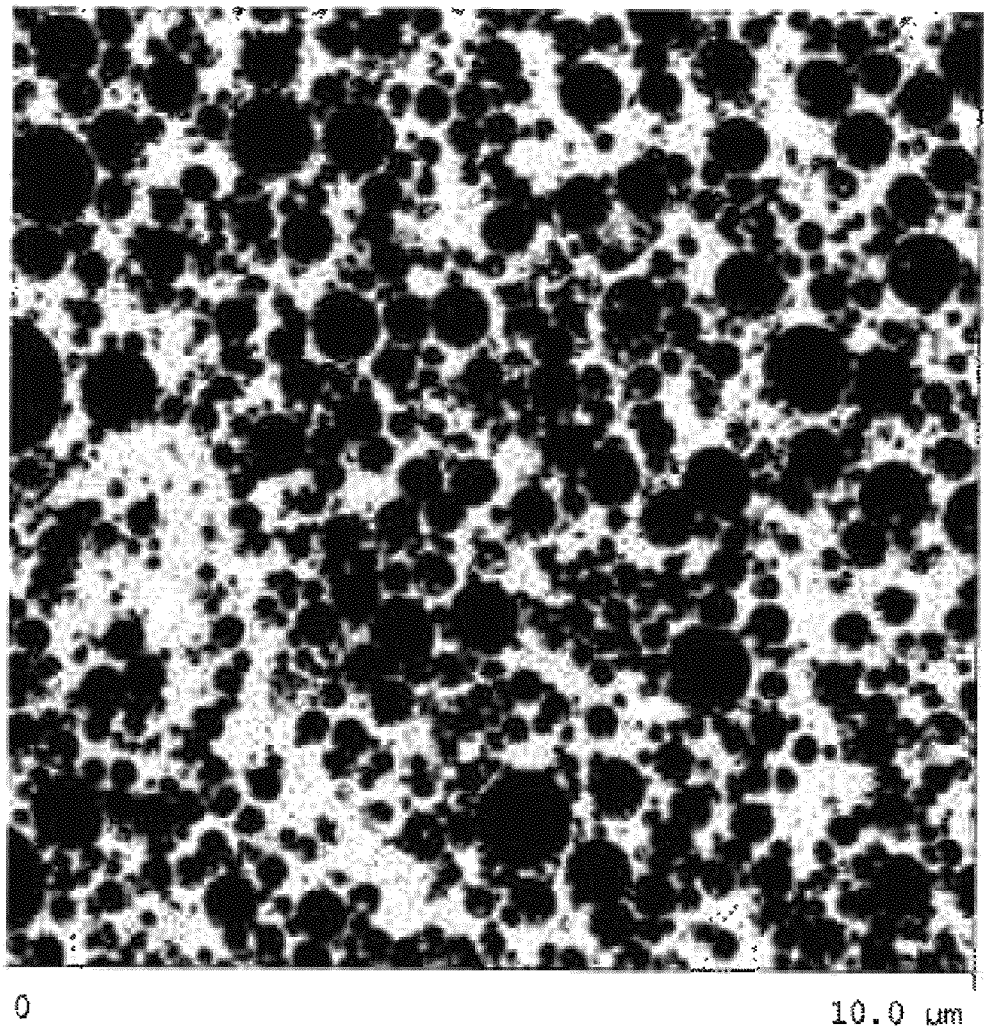
FIG. 4 is a Tapping Mode Atomic Force Microscope cross-section view of a first film made at room temperature.

Drying the dispersion incorporated into, for example, the cellulose-based composition at a temperature in the range of less than the melting point temperature of the base polymer is important because it facilitates the formation of a film, as shown in FIG. 4, having a continuous stabilizing agent phase with a discrete base polymer phase dispersed therein the continuous stabilizing agent phase thereby improving the rebrokeability of the cellulose-based composition incorporating the dispersion.

Figure 5:
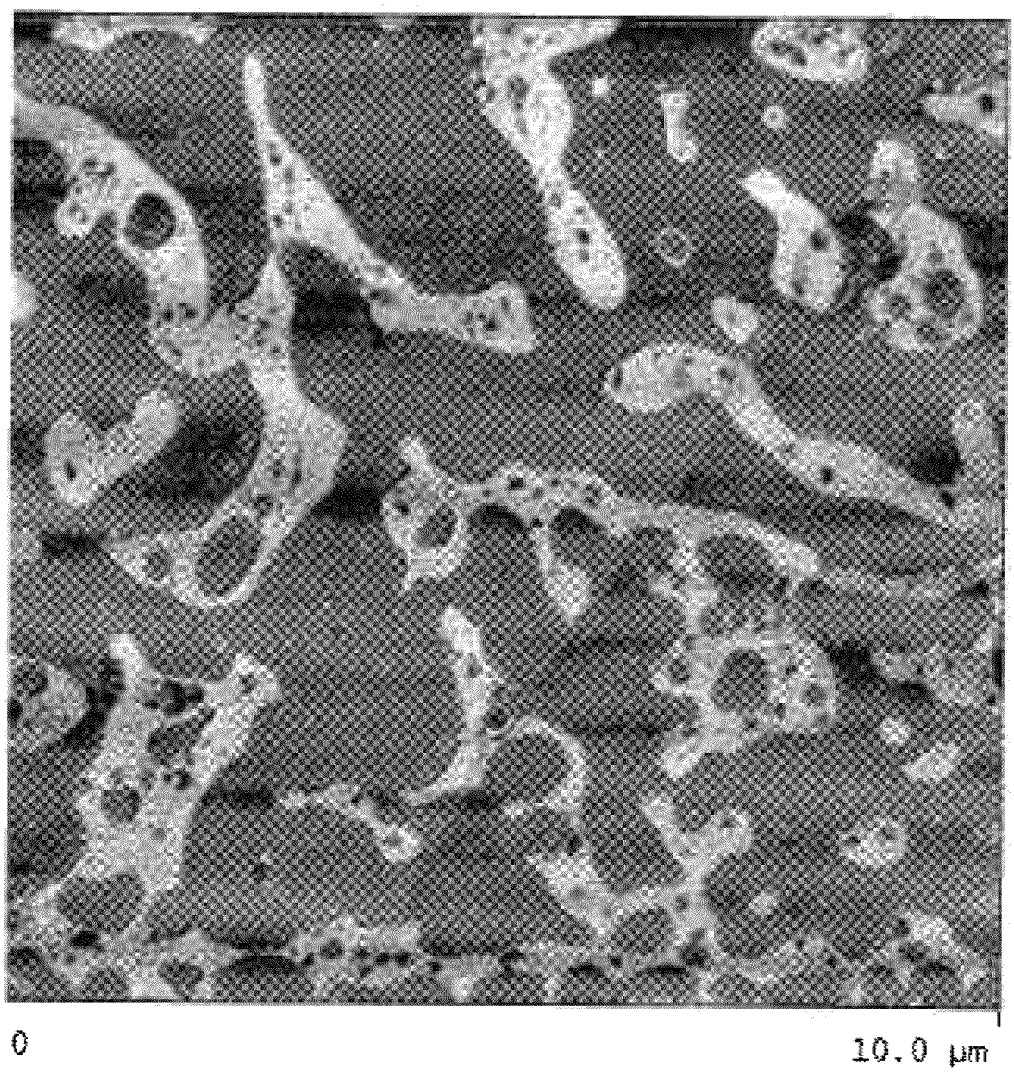
FIG. 5 is a Tapping Mode Atomic Force Microscope cross-section view of a second film made at elevated temperatures.

Drying the dispersion incorporated into, for example, the cellulose-based composition at a temperature in the range of equal or greater than the melting point temperature of the base polymer is important because it facilitates the formation of a film, as shown in FIG. 5, having a continuous base polymer phase with a discrete stabilizing agent phase dispersed therein the continuous base polymer phase thereby improving the oil and grease resistance as well as providing a barrier for moisture and vapor transmission.

Preparation of Webs

The cellulosic web can be made by any method known in the art. The cellulosic web can be wetlaid, such as a paper web formed with known paper making techniques wherein a dilute aqueous fiber slurry is disposed on a moving wire to filter out the fibers and form a paper web which is subsequently dewatered by combinations of units including suction boxes, wet presses, dryer units, and the like. Examples of known dewatering techniques such as capillary dewatering can also be applied to remove water from the web, as disclosed in U.S. Pat. No. 5,598,643, issued on Feb. 4, 1997, and those techniques disclosed in U.S. Pat. No. 4,556,450, issued on Dec. 3, 1985, both to S. C. Chuang et al Various drying operations may be useful in the manufacture of the products of the present invention. Examples of such drying methods include, but are not limited to, drum drying, through drying, steam drying such as superheated steam drying, displacement dewatering, Yankee drying, infrared drying, microwave drying, radiofrequency drying in general, and impulse drying, as disclosed in U.S. Pat. No. 5,353,521, issued on Oct. 11, 1994 to Orloff and U.S. Pat. No. 5,598,642, issued on Feb. 4, 1997 to Orloff et al., the disclosures of both which are herein incorporated by reference to the extent that they are non-contradictory herewith. Other drying technologies may be used, such as methods employing differential gas pressure include the use of air presses as disclosed U.S. Pat. No. 6,096,169, issued on Aug. 1, 2000 to Hermans et al. and U.S. Pat. No. 6,143,135, issued on Nov. 7, 2000 to Hada et al., the disclosures of both which are herein incorporated by reference to the extent they are non-contradictory herewith. Also relevant are the paper machines disclosed in U.S. Pat. No. 5,230,776, issued on Jul. 27, 1993 to I. A. Andersson et al. Drying methods disclosed in U.S. Pat. Nos. 6,949,167, 6,837,970, and 6,808,595, each of which is herein incorporated by reference, may also be employed. For application where softness is a desired end property, non-compressive means of drying can be employed.

The cellulose article should exit the drying step at a minimum temperature that is similar to the peak melting point of the polymer base of the dispersion while staying below temperatures that would damage the cellulose substrate. For example, useful temperatures would be from 90° C. to 140° C.

For paper webs, a number of methods of manufacture may be used. Representative methods are disclosed in U.S. Pat. No. 5,637,194, issued on Jun. 10, 1997 to Ampulski et al. and U.S. Pat. No. 4,529,480, issued on Jul. 16, 1985 to Trokhan; which are herein incorporated by reference to the extent that they are non-contradictory herewith.

Cellulosic webs may be imprinted against a deflection member prior to complete drying. Deflection members have deflection conduits between raised elements, and the cellulosic web is deflected into the deflection member by an air pressure differential to create bulky domes, while the portions of the cellulosic web residing on the surface of the raised elements can be pressed against the dryer surface to create a network of pattern densified areas offering strength. Deflection members and fabrics of use in imprinting a cellulosic web, as well as related methods of cellulosic manufacture, are disclosed in the following: in U.S. Pat. No. 4,529,480, issued on Jul. 16, 1985 to Trokhan; U.S. Pat. No. 4,514,345, issued on Apr. 30, 1985 to Johnson et al.; U.S. Pat. No. 4,528,239, issued on Jul. 9, 1985 to Trokhan; U.S. Pat. No. 5,098,522, issued on Mar. 24, 1992 to Smurkoski; U.S. Pat. No. 5,260,171, issued on Nov. 9, 1993 to Smurkoski et al.; U.S. Pat. No. 5,275,700, issued on Jan. 4, 1994 to Trokhan; U.S. Pat. No. 5,334,289, issued on Aug. 2, 1994 to Trokhan et al.; U.S. Pat. No. 5,496,624, issued on Mar. 5, 1996 to Stelljes, Jr. et al.; U.S. Pat. No. 6,010,598, issued on Jan. 4, 2000 to Boutilier et al.; and, U.S. Pat. No. 5,628,876, issued on May 13, 1997 to Ayers et al., as well as commonly owned application Ser. No. 09/705,684 by Lindsay et al. Further, other methods, dealing with higher density papers, are disclosed in U.S. Pat. Nos. 6,702,925 and 6,372,091 and U.S. Patent Publication No. 2005023007 all of which are herein incorporated by reference to the extent that they are non-contradictory herewith.

The fibrous web is generally a random plurality of papermaking fibers that can, optionally, be joined together with a binder. Any papermaking fibers, as previously defined, or mixtures thereof may be used, such as bleached fibers from a kraft or sulfite chemical pulping process. Recycled fibers can also be used, as can cotton linters or papermaking fibers comprising cotton. Both high-yield and low-yield fibers can be used. In one embodiment, the fibers may be predominantly hardwood, such as at least 50% hardwood or about 60% hardwood or great or about 80% hardwood or greater or substantially 100% hardwood. In another embodiment, the web is predominantly softwood, such as at least about 50% softwood or at least about 80% softwood, or about 100% softwood.

The fibrous web of the present invention may be formed from a single layer or multiple layers. Both strength and softness are often achieved through layered webs, such as those produced from stratified headboxes wherein at least one layer delivered by the headbox comprises softwood fibers while another layer comprises hardwood or other fiber types. In the case of multiple layers, the layers are generally positioned in a juxtaposed or surface-to-surface relationship and all or a portion of the layers may be bound to adjacent layers. The cellulosic web may also be formed from a plurality of separate cellulosic webs wherein the separate cellulosic webs may be formed from single or multiple layers.

Dry airlaid cellulosic webs can also be treated with semi-synthetic cationic polymers. Airlaid cellulosic webs can be formed by any method known in the art, and generally comprise entraining fiberized or comminuted cellulosic fibers in an air stream and depositing the fibers to form a mat. The mat may then be calendered or compressed, before or after chemical treatment using known techniques, including those of U.S. Pat. No. 5,948,507 issued on Sep. 7, 1999 to Chen et al., herein incorporated by reference to the extent that it is non-contradictory herewith.

Optional Chemical Additives

Optional chemical additives may also be added to the aqueous papermaking furnish or to the paper to impart additional benefits to the product and/or process and are not antagonistic to the intended benefits of the present invention. The following materials are included as examples of additional chemicals that may be applied to the paper sheet with or in addition to the polymeric dispersions of the present invention. The chemicals are included as examples and are not intended to limit the scope of the present invention. Such chemicals may be added at any point in the papermaking process, such as before or after addition of the polymeric dispersion. They may also be added simultaneously with the copolymer dispersion. They may be blended with the copolymer dispersions.

Optional chemical additives which may be used in the present invention include those disclosed in U.S. Pat. Nos. 6,949,167 and 6,897,168, each of which is incorporated herein by reference. For example, the optional chemical additives can include: hydrophobic additives; wetting agents; binders; charge promoters or charge controllers; strength agents, including wet strength agents, temporary wet strength agents, and dry strength agents; debonders; softening agents; synthetic fibers; odor control agents; fragrances; absorbency aids, such as superabsorbent particles; dyes; brighteners; lotions or other skin care additives; detackifying agents; microparticulates; microcapsules and other delivery vehicles; preservatives and anti-microbial agents; cleaning agents; silicone; emollients; surface feel modifiers; opacifiers; pH control agents; and drying aids, among others.

The application point for such materials and chemicals is not particularly relevant to the present invention and such materials and chemicals may be applied at any point in the paper manufacturing process. This includes pre-treatment of pulp, co-application in the wet end of the process, post treatment after drying but on the paper machine and topical post treatment. The chemical additives may be combined and incorporated into a paper web along with the dispersions described above.

Advantages of the present invention include rebrokeability, improved oil and grease resistance, improved water resistance, and an improvement in both softness and strength.

Rebrokeability: an important attribute for efficient operations within a paper mill is the ability of the paper composition to be reclaimed within the process. Edge trim and paper made during startup/shutdown is typically rebroked (transformed back into a slurry of pulp) and used again to make virgin paper. Many prior art polyolefin compositions are not rebrokeable. However, specific formulations which use ethylene-acrylic acid, or other copolymers as the stabilizing agent are rebrokeable.

Improved oil/grease and water resistance: one advantage of this invention is the ability to achieve specific levels of oil and grease or water resistance. Depending on the particular polyolefin dispersion used, Kit, a measure of the oil and grease resistance (OGR) of paper or board, can vary from six, (moderate performance) up to 12 (high performance). High levels of Kit are often needed for demanding packaging applications such as pet food bags, pizza boxes, hamburger wrappers, and the like. Advantageously, embodiments of the present invention may allow for the cellulose article to maintain oil, grease, and/or moisture resistance after having been creased.

Combination of softness and strength: another key advantage described in this invention is the ability to incorporate certain polyolefin dispersions using a variety of methods to yield cellulose structures having improved strength (measured by tensile strength of tensile energy absorbed) while maintaining or improving softness.

Production cost and efficiency: another major advantage described in this invention is the ability to produce enhanced cellulose articles at high speeds (on papermaking equipment) using various application techniques. This allows the cellulose article producer to balance end-product performance with manufacturing efficiency and cost through a combination of dispersion composition and the method used to apply the dispersion.

The polymer composition used to modify the cellulose article is critical to enhancing properties such as OGR and strength. The polyolefin is composed mainly of the base polymer and the dispersing agent(s). The base polymer typically comprises at least 50% of the nonaqueous portion of the dispersion. The dispersing agent comprises from about 2% up to about 40% by weight of the total solids content of the dispersion. The amount of dispersing agent depends greatly on type of agent used. Low molecular weight surfactants such as fatty acids and their salts can be used at very low levels, down to about 2% by weight of the total solids content of the dispersion.

The combination of base polymer and stabilizing agent may affect dispersion properties which are important for achieving enhanced properties in the cellulose article. For example, the type and amount of stabilizing agent, or the type and amount of polymer can affect the properties of the dispersion, thereby affecting the resulting film formation, the adhesion of the polymer and stabilizing agent to a substrate, such as cellulose, oil and grease resistance, and other properties.

Film formation: for many applications, formation of a continuous film is critical to achieving moisture and oil/grease barrier. In the case of coatings on cellulose articles, failure to form a continuous film causes pinholes to remain in the coating and compromise the barrier performance. Film formation may be enhanced by a variety of dispersion parameters including the incorporation of greater amounts (30% by weight of the total solids content of the dispersion and higher) of ethylene-acrylic (EAA) copolymer, neutralizing the EAA copolymer to a greater extent to form the corresponding salt (at least 50-60% neutralized up to 100%), and the use of a base polymer having a lower melting point. In certain embodiments, the base polymer can have a melting point less than 110° C. In other embodiments, the melting point can be less than 100° C.; in preferred embodiments, the melting point can be less than 90° C.

Adhesion to cellulose: in applications where strength is required, adhesion between the dispersed polymer and the cellulose structure is critical. Adhesion may be enhanced by the incorporation of greater amounts (10% by weight of the total solids content of the dispersion and higher) of ethylene-acrylic (EAA) copolymer. Adhesion to cellulose may be improved by the addition of maleic anhydride grafted to polymers.

Resistance to oil and grease: in applications where OGR is required, the resistance of the dried polymer to attack by oil and grease is critical. Resistance to chemical attack may be enhanced by the incorporation of greater amounts (10% by weight of the total solids content of the dispersion and higher) of ethylene-acrylic (EAA) copolymer and in select embodiment, neutralizing the EAA copolymer to a greater extent (i.e., greater than about 50% neutralization of the EAA on a molar basis of acrylic acid) to form the corresponding salt.

In addition to the composition of the polyolefin and stabilizing agent used in the dispersion added to the cellulose, the manner in which it is incorporated may also have a significant impact. Topical addition of the polyolefin to the cellulose article (which can be either wet or dry), such as by spraying, extrusion, or printing, for example, may be preferred for higher barrier (oil, grease, water) applications. Incorporation into the cellulose article by pre-mixing with the fibers that are used to form the article may be preferred for optimizing strength and softness properties. In other embodiments, dispersions formulated in accordance with the present invention may be used as a heat sealable coating on paper, a primer/adhesive layer to allow paper to be bonded to other substrates (such as plastic films, foil, and other paper), and/or a coefficient of friction modifier on paper. Depending on the crystallinity or hardness of the dispersion, the coefficient of friction maybe increased or decreased. For example, low crystallinity dispersions may be effective as an anti-skid coating for boxes (i.e., increasing the coefficient of friction).

EXAMPLES

Dispersion Formation: In each of the following examples which include dispersions, the dispersions were formed in accordance with the procedures as described in WO2005021638, incorporated herein by reference, and briefly described above with respect to FIG. 1.

Dispersion 1 was formed using an ethylene-octene copolymer and a surfactant system. The ethylene-octene copolymer used was AFFINITY™ EG 8200 plastomer (a copolymer available from The Dow Chemical Company having a density of about 0.87 g/cm$^3$ (ASTM D-792) and a melt index of about 5 g/10 min. as determined according to ASTM D1238 at 190° C. and 2.16 kg). The surfactant system used was a combination of UNICID™ 350 (a C26 carboxylic acid obtained from Baker-Petrolite, acid value 115 mg KOH/g) and AEROSOL™ OT-100 (a dioctyl sodium sulfosuccinate obtained from Cytec Industries). UNICID™ and AEROSOL™ were used at a loading of 3% and 1% by weight, respectively, based on the weight of EG 8200. An aqueous dispersion having a solids content of 53.1 wt % at a pH 10.3 was obtained. The dispersed polymer phase measured by a Coulter LS230 particle analyzer consisted of an average volume diameter of 0.99 micron and a particle size distribution (Dv/Dn) of 1.58. In selected embodiments, dispersions mentioned herein were formulated in accordance with the methods disclosed in WO2005021638.

Dispersion 2 was also formed using AFFINITY™ EG 8200 plastomer and a surfactant system. The surfactant system used was 30% by weight (based on the amount of EG 8200) of PRIMACOR™ 5980I copolymer (an ethylene-acrylic acid copolymer obtained from The Dow Chemical Company having a melt index of about 15 g/10 min. determined according to ASTM D1238 at 125° C./2.16 kg and an acrylic acid content of about 20.5% by weight). An aqueous dispersion having a solids content of 38.8 wt % at a pH 10.2 was obtained. The dispersed polymer phase measured by a Coulter LS230 particle analyzer consisted of an average volume diameter of 0.96 micron and a particle size distribution (Dv/Dn) of 1.94.

AFFINITY™ EG 8185—ethylene-octene copolymer having a density of 0.885 g/cc (ASTM D792) and a melt index of 30 g/10 min (190° C./2.16 kg, ASTM D1238). In addition, Composition A, which is an experimental propylene-based plastomer or elastomer ("PBPE") having a density of 0.876 grams/cm3, a melt flow rate (230° C./2.16 kg) of 8 grams/10 min and an ethylene content of 9% by weight of the PBPE was used. These PBPE materials are taught in WO03/040442, and U.S. application 60/709,688 (filed Aug. 19, 2005), each of which is hereby incorporated by reference in its entirety.

Examples 1 through 8 were coated with a dispersion, where the dispersion was applied onto the rough side of a Fraser basestock having a basis weight of 59 g/m$^2$ using wound rods. Table 1 shows the specific combination of dispersion composition, coating thickness, and drying time using to generate Examples 1 through 8. The drying of the dispersion coating onto the paper substrate was performed at 149° C. (300° F.) using a convection oven.

TABLE 1

Coating Thickness and Drying Time for Examples 1 through 8.

| Sample | Formulation | Coating Thickness (kg dry/1000 m$^2$) | Coating Thickness (lb dry/3300 ft$^2$) | Drying Time (minutes) |
|---|---|---|---|---|
| 1 | Dispersion 1 | 8.9 | 6 | 1 |
| 2 | Dispersion 1 | 8.9 | 6 | 5 |
| 3 | Dispersion 1 | 14.8 | 10 | 1 |
| 4 | Dispersion 1 | 14.8 | 10 | 5 |
| 5 | Dispersion 2 | 8.9 | 6 | 1 |
| 6 | Dispersion 2 | 8.9 | 6 | 5 |
| 7 | Dispersion 2 | 14.8 | 10 | 1 |
| 8 | Dispersion 2 | 14.8 | 10 | 5 |

Samples 1 through 8 were tested to determine their performance when exposed to oil. The hot oil evaluation was performed by placing a drop of oil on each sample and the drops were examined at various time intervals to determine the degree to which the oil penetrated the sample. Test oils consisted of sesame, vegetable, canola, olive, peanut, corn, and oleic acid. The oils were preheated to 140° F. in an oven. A 6×7 inch coated sheet was taped onto a PLEXIGLAS® acrylic sheet. A drop of oil was then placed on the sample surface and the time recorded. Samples were then rated on a pass to fail scale, immediately without oil wipe-off. This is the immediate or "I" reading on the test chart.

The pass to fail scale is rated as follows:

P=Pass, i.e. no staining noted on front-side or backside

LS=Lightly Saturated, i.e. stain not through to backside of paper

HS=Highly Saturated, i.e. spreading stain through to backside of paper

S=for complete saturation of the fiber network

A#=Number of pinholes noted in the field of the drop

M=Multiple pinholes in the field of the oil drop

The samples were rated again after one hour at ambient conditions. This reading is indicated as "1" (1 hour) on the test chart.

The treated samples were then placed in a 140° F. oven overnight. After 20 to 24 hours in the oven, the samples were taken out and the oils wiped off the surface. The backsides of the samples were observed through the PLEXIGLAS® acrylic sheet. Staining through to the backside is more easily observed with back lighting. Alternatively, the samples were removed completely from the PLEXIGLAS® acrylic sheet. The total amount of time from initial to final reading was recorded to the nearest 0.5 hour.

Hot oil test results are shown in Table 2.

TABLE 2

Hot Oil Evaluation for Samples 1 through 8.

| | Oil Type | | | | | | | | | | | | | | | | | | | | |
|---|---|---|---|---|---|---|---|---|---|---|---|---|---|---|---|---|---|---|---|---|---|
| | Corn | | | Sesame | | | Vegetable | | | Olive | | | Peanut | | | Canola | | | Oleic | | |
| | Exposure Time | | | | | | | | | | | | | | | | | | | | |
| | I | 1 | 24 | I | 1 | 24 | I | 1 | 24 | I | 1 | 24 | I | 1 | 24 | I | 1 | 24 | I | 1 | 24 |
| Sample 1 | P | P | HS | P | P | HS | P | P | HS | P | P | HS | P | P | HS | A1 | HS | HS | P | P | HS |
| Sample 2 | P | P | HS | P | A1 | HS | P | P | HS | P | P | HS | P | P | LS | P | P | HS | P | P | HS |
| Sample 3 | P | P | HS | P | P | LS | P | P | LS | P | P | HS | P | P | LS | P | P | HS | P | P | HS |
| Sample 4 | P | P | HS | P | P | HS | P | P | HS | P | P | HS | P | 1 | HS | P | A1 | HS | P | A2 | HS |
| Sample 5 | P | P | A1 | P | P | A1 | P | P | P | P | P | A1 | P | P | P | P | P | A1 | P | P | HS |
| Sample 6 | P | P | P | P | P | P | P | P | P | P | P | P | P | P | P | P | P | P | P | P | HS |
| Sample 7 | P | P | HS | P | P | M | P | P | A2 | P | P | LS | P | P | LS | P | P | HS | P | A3 | HS |
| Sample 8 | P | P | P | P | P | A3 | P | P | LS | P | P | HS | P | P | P | P | P | A2 | P | P | HS |

The Kit test: the kit value of each sample was determined using TAPPI T559 cm-02. The test was performed flat as described in the TAPPI test. This involves putting five separate drops of oil onto the board's surface and inspecting the board after a specified amount of exposure time (15 seconds) to see if any pronounced darkening of the paper appears. Each solution is numbered up to a maximum of 12 and the higher the number achieved the more resilient the surface. Kit test results are shown in Table 3.

TABLE 3

Kit Test results for Samples 1 through 8.

| Sample | Kit Average | Std. Deviation |
|---|---|---|
| 1 | 6.5 | 2.1 |
| 2 | 4.5 | 1.1 |
| 3 | 6.0 | 1.1 |
| 4 | 6.0 | 1.5 |
| 5 | 12.0 | 0 |
| 6 | 12.0 | 0 |

TABLE 3-continued

Kit Test results for Samples 1 through 8.

| Sample | Kit Average | Std. Deviation |
|---|---|---|
| 7 | 12.0 | 0 |
| 8 | 12.0 | 0 |

These data show that Samples 1 through 4 show good performance yielding moderately high Kit values and good performance in the hot oil evaluation at oil exposure times up to 1 hour. This data shows that Samples 5 through 8 show excellent performance yielding maximum Kit values and good performance Several dispersions were analyzed for moisture barrier properties and for water resistance, and are detailed in Table 4. Dispersions 3-7 serve as comparative examples to embodiments of the present invention, as dispersions 3-7 do not include both a polymer and a stabilizing agent. Dispersions 3 through 13 were applied on kraft paper, coated with rod # 3 and dried at 120° C. The moisture vapor transmission rates and water resistance of the coated paper samples were then measured and compared to uncoated kraft paper.

TABLE 4

Composition of Dispersions 3 through 13.

| Dispersion | Polymer | Polymer Amount (weight % of total solids) | Stabilizing Agent | Stabilizing Agent Amount (weight % of total solids) | Neutralizing Agent |
|---|---|---|---|---|---|
| 3 | | 0 | PRIMACOR ™ 5980I | 100% | Ammonia |
| 4 | | 0 | PRIMACOR ™ 5980I | 100% | Ammonia |
| 5 | | 0 | PRIMACOR ™ 5980I | 100% | Potassium Hydroxide |
| 6 | | 0 | PRIMACOR ™ 5980I | 100% | Potassium Hydroxide |
| 7 | | 0 | PRIMACOR ™ 5980I | 100% | Potassium Hydroxide |
| 8 | AFFINITY ™ EG 8185 | 96% | UNICID ™ 350, AEROSOL ™ OT-100 | 3% U-350, 1% OT-100 | Potassium Hydroxide |
| 9 | AFFINITY ™ EG 8185 | 70% | PRIMACOR ™ 5980I | 30% | Potassium Hydroxide |
| 10 | 70% Dispersion 3/ 30% Dispersion 8 | — | | — | |

TABLE 4-continued

Composition of Dispersions 3 through 13.

| Dispersion | Polymer | Polymer Amount (weight % of total solids) | Stabilizing Agent | Stabilizing Agent Amount (weight % of total solids) | Neutralizing Agent |
|---|---|---|---|---|---|
| 11 | Composition A | 85% | PRIMACOR ™ 5980I | 15% | Potassium Hydroxide |
| 12 | Composition A | 70% | PRIMACOR ™ 5980I | 30% | Potassium Hydroxide |
| 13 | Composition A | 70% | PRIMACOR ™ 5980I | 30% | Potassium Hydroxide |

Table 5 provides additional detail about certain of the dispersions shown above. The viscosity was measured using an RV2 spindle at 23° C. and 100 rpm.

TABLE 5

| Dispersion | Total solids content (wt %) | Brookfield viscosity cP | pH | Particle Size (microns) |
|---|---|---|---|---|
| 3 | 25.0 | 200 | 9.0 | <0.3 |
| 4 | 34.2 | 168 | 8.0 | <0.3 |
| 5 | 25.0 | 200 | 9.5 | <0.3 |
| 6 | 42.5 | 268 | 7.8 | <0.3 |
| 8 | 50.7 | 56 | 12.2 | 1.0 |
| 9 | 43.8 | 510 | 11.0 | 0.4 |
| 11 | 43.4 | 80 | 10.9 | 1.1 |
| 12 | 36.8 | 50 | 10.0 | 2.3 |
| 13 | 45.0 | 150 | 9.5 | 2.1 |

Dispersion 14 was also formed, according the instant invention, using AFFINITY™ EG 8200 plastomer and a surfactant system. The surfactant system used was 40% by weight (based on the amount of EG 8200) of PRIMACOR™ 5980I copolymer (an ethylene-acrylic acid copolymer obtained from The Dow Chemical Company having a melt index of about 15 g/10 min. determined according to ASTM D1238 at 125° C./2.16 kg and an acrylic acid content of about 20.5% by weight). An aqueous dispersion having a solids content of about 38 wt % at a pH of approximately 10 was obtained. The dispersed polymer phase measured by a Coulter LS230 particle analyzer consisted of an average volume diameter of approximately 0.9 micron and a particle size distribution (Dv/Dn) of approximately 2.7. Potassium hydroxide was used as the neutralizing agent. The degree of acid neutralization, which is based on the amount of the base solution, i.e. potassium hydroxide, consumed for the neutralization of the acid, was 95% of the total amount of the acid. Dispersion 14 was formed into a first film, and air dried. FIG. 4 is a Tapping Mode Atomic Force Microscope cross-section view of this first film made at room temperature. First film, as shown in FIG. 4, includes a continuous stabilizing agent phase with a discrete base polymer phase dispersed therein the continuous stabilizing agent phase. Dispersion 14 was also formed into a second film via spraying the dispersion onto a heated drum with surface air temperature of 120° C. FIG. 5 is a Tapping Mode Atomic Force Microscope cross-section view of this second dispersion film made at elevated temperatures. The second dispersion film, as shown in FIG. 5, includes a continuous base polymer phase with a discrete stabilizing agent phase dispersed therein the continuous base polymer phase.

Figure 2:
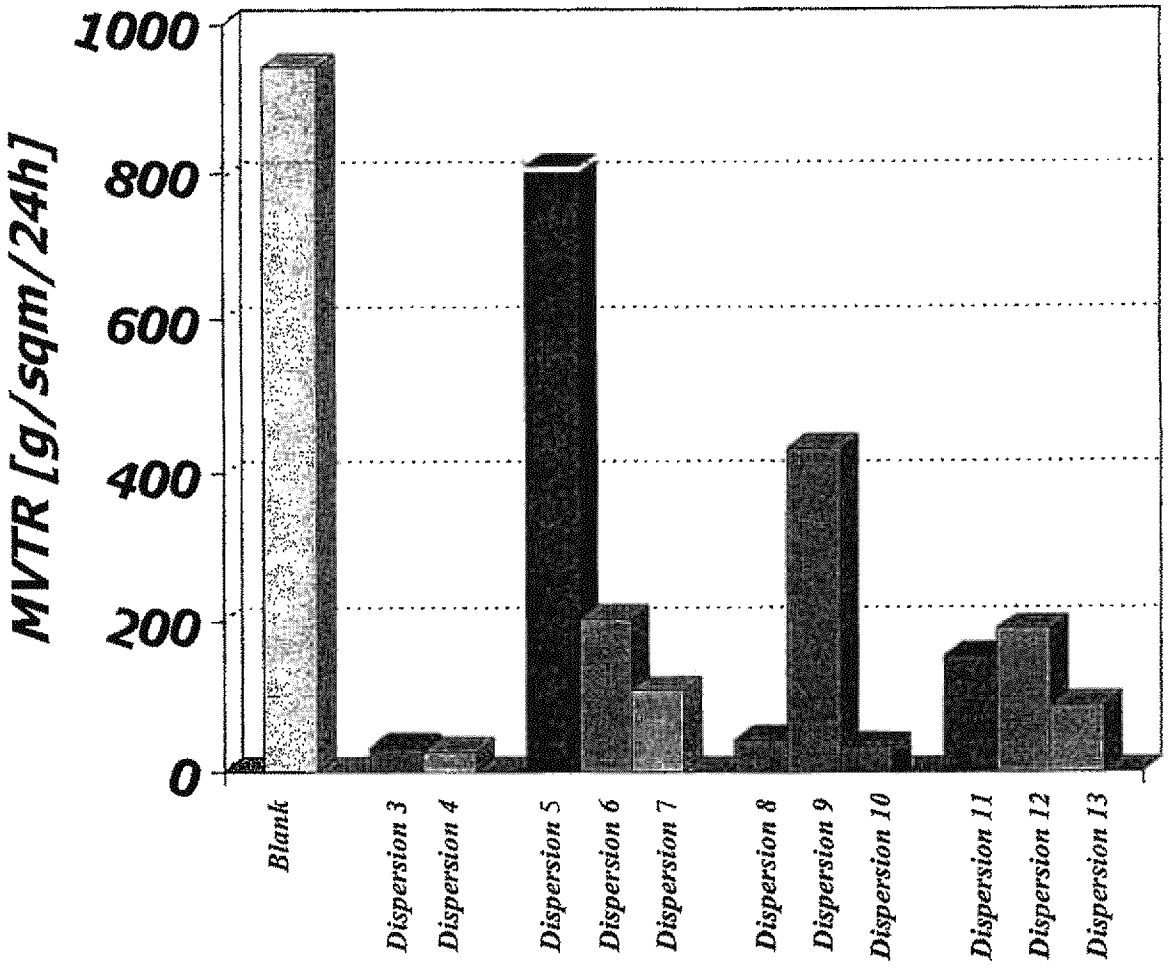
FIG. 2 is a chart presenting moisture vapor transmission rates of cellulose-based articles formed using embodiments of the present invention as described in the Examples below.

The moisture vapor transmission rate (MVTR) was measured using ASTM E96-80 dish test. The test measures the transmission of moisture from a wet chamber through a test specimen (sheet) and into a dry chamber containing a dessicant. The MVTR experiments performed were performed at room temperature with a wet chamber relative humidity of 70%. The moisture vapor transmission rates for sheets incorporating Dispersions 3 through 13 are shown in FIG. 2.

In embodiments of the present invention, the total solids content, i.e., a combined amount of the at least one polymer and the at least one stabilizing agent comprises about 25 to about 74 volume percent of the total aqueous dispersion. In other embodiments, the combined amount may be about 30% to 60%.

Figure 3:
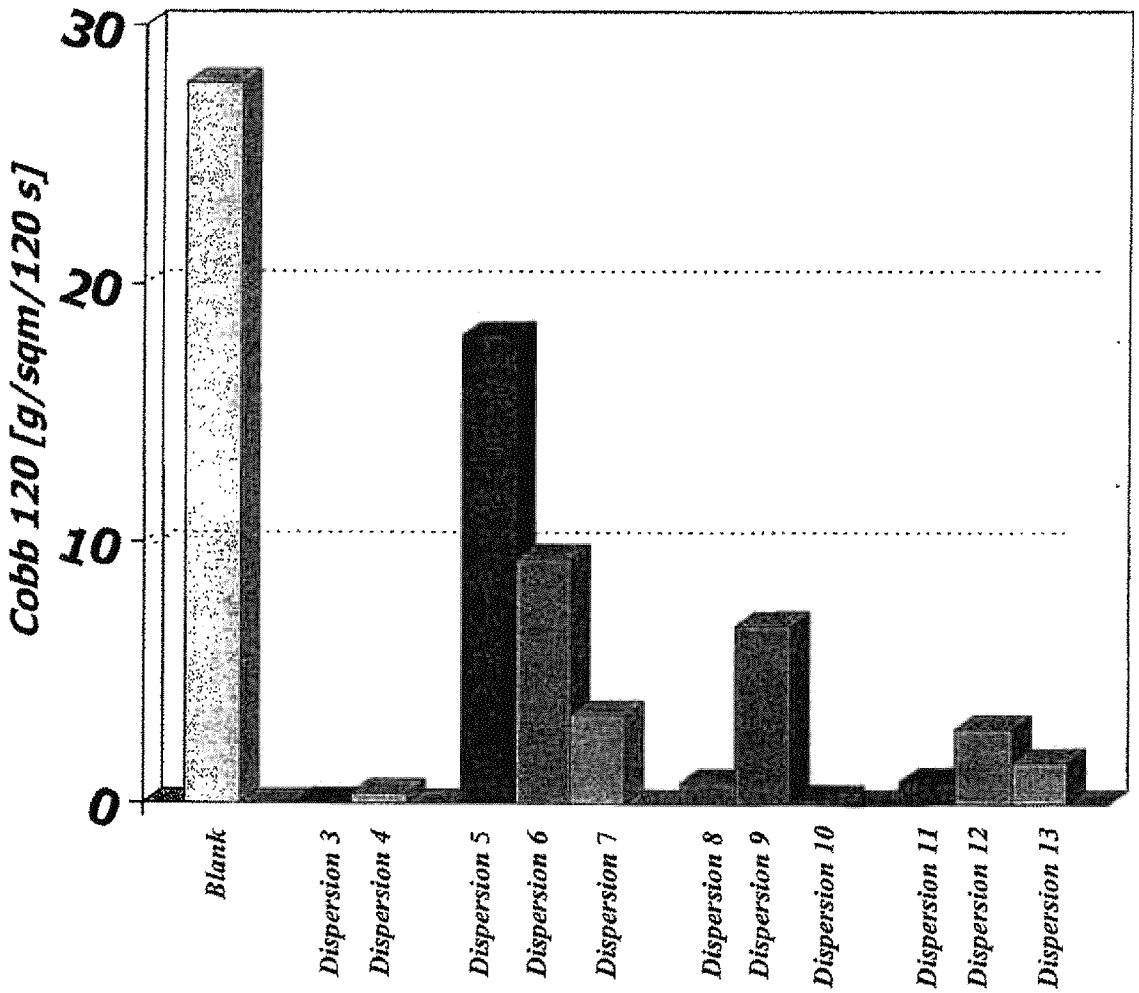
FIG. 3 is a chart presenting the water resistance of cellulose-based articles formed using embodiments of the present invention as described in the Examples below.

The water resistance/absorption was measured using a Cobb test in accordance with ASTM D3285-93. The exposure time was 2 minutes. The test involves a known volume of water (100 ml) being poured onto a specific area of the board's surface (100 $cm^2$). The board is weighed before and after the exposure and the difference between the two can then be expressed as the weight per unit area of water absorbed in that given time; the lower the Cobb value, the better the result. FIG. 3 shows the water resistance via Cobb test for examples 3 through 13.

These data show that the amount of soluble potassium salt has a detrimental performance on water resistance/barrier. The samples that performed best either used ammonia as the neutralizing base for EAA or used KOH as the neutralizing base for the fatty acid.

As used herein, the specific volumes of cellulose articles in accordance with embodiments of the present invention may be less about 3 cc/g. In other embodiments, the specific volumes may range from 1 cc/g to 2.5 cc/g. The specific volume is calculated as the quotient of the caliper of a dry sheet, expressed in microns, divided by the dry basis weight, expressed in grams per square meter. The resulting specific volume is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

Standard CRYSTAF Method

Branching distributions are determined by crystallization analysis fractionation (CRYSTAF) using a CRYSTAF 200 unit commercially available from PolymerChar, Valencia, Spain. The samples are dissolved in 1,2,4 trichlorobenzene at 160° C. (0.66 mg/mL) for 1 hr and stabilized at 95° C. for 45 minutes. The sampling temperatures range from 95 to 30° C. at a cooling rate of 0.2° C./min. An infrared detector is used to measure the polymer solution concentrations. The cumulative soluble concentration is measured as the polymer crystallizes while the temperature is decreased. The analytical derivative of the cumulative profile reflects the short chain branching distribution of the polymer.

The CRYSTAF peak temperature and area are identified by the peak analysis module included in the CRYSTAF Software (Version 2001.b, PolymerChar, Valencia, Spain). The CRYSTAF peak finding routine identifies a peak temperature as a maximum in the dW/dT curve and the area between the largest positive inflections on either side of the identified peak in the derivative curve. To calculate the CRYSTAF curve, the preferred processing parameters are with a temperature limit of 70° C. and with smoothing parameters above the temperature limit of 0.1, and below the temperature limit of 0.3.

Flexural/Secant Modulus/Storage Modulus

Samples are compression molded using ASTM D 1928. Flexural and 2 percent secant moduli are measured according to ASTM D-790. Storage modulus is measured according to ASTM D 5026-01 or equivalent technique.

DSC Standard Method

Differential Scanning Calorimetry results are determined using a TAI model Q1000 DSC equipped with an RCS cooling accessory and an autosampler. A nitrogen purge gas flow of 50 ml/min is used. The sample is pressed into a thin film and melted in the press at about 175° C. and then air-cooled to room temperature (25° C.). 3-10 mg of material is then cut into a 6 mm diameter disk, accurately weighed, placed in a light aluminum pan (ca 50 mg), and then crimped shut. The thermal behavior of the sample is investigated with the following temperature profile. The sample is rapidly heated to 180° C. and held isothermal for 3 minutes in order to remove any previous thermal history. The sample is then cooled to −40° C. at 10° C./min cooling rate and held at −40° C. for 3 minutes. The sample is then heated to 150° C. at 10° C./min. heating rate. The cooling and second heating curves are recorded.

The DSC melting peak is measured as the maximum in heat flow rate (W/g) with respect to the linear baseline drawn between −30° C. and end of melting. The heat of fusion is measured as the area under the melting curve between −30° C. and the end of melting using a linear baseline.

Calibration of the DSC is done as follows. First, a baseline is obtained by running a DSC from −90° C. without any sample in the aluminum DSC pan. Then 7 milligrams of a fresh indium sample is analyzed by heating the sample to 180° C., cooling the sample to 140° C. at a cooling rate of 10° C./min followed by keeping the sample isothermally at 140° C. for 1 minute, followed by heating the sample from 140° C. to 180° C. at a heating rate of 10° C. per minute. The heat of fusion and the onset of melting of the indium sample are determined and checked to be within 0.5° C. from 156.6° C. for the onset of melting and within 0.5 J/g from 28.71 J/g for the of fusion. Then deionized water is analyzed by cooling a small drop of fresh sample in the DSC pan from 25° C. to −30° C. at a cooling rate of 10° C. per minute. The sample is kept isothermally at −30° C. for 2 minutes and heat to 30° C. at a heating rate of 10° C. per minute. The onset of melting is determined and checked to be within 0.5° C. from 0° C.

GPC Method

The gel permeation chromatographic system consists of either a Polymer Laboratories Model PL-210 or a Polymer Laboratories Model PL-220 instrument. The column and carousel compartments are operated at 140° C. Three Polymer Laboratories 10-micron Mixed-B columns are used. The solvent is 1,2,4 trichlorobenzene. The samples are prepared at a concentration of 0.1 grams of polymer in 50 milliliters of solvent containing 200 ppm of butylated hydroxytoluene (BHT). Samples are prepared by agitating lightly for 2 hours at 160° C. The injection volume used is 100 microliters and the flow rate is 1.0 ml/minute.

Calibration of the GPC column set is performed with 21 narrow molecular weight distribution polystyrene standards with molecular weights ranging from 580 to 8,400,000, arranged in 6 "cocktail" mixtures with at least a decade of separation between individual molecular weights. The standards are purchased from Polymer Laboratories (Shropshire, UK). The polystyrene standards are prepared at 0.025 grams in 50 milliliters of solvent for molecular weights equal to or greater than 1,000,000, and 0.05 grams in 50 milliliters of solvent for molecular weights less than 1,000,000. The polystyrene standards are dissolved at 80° C. with gentle agitation for 30 minutes. The narrow standards mixtures are run first and in order of decreasing highest molecular weight component to minimize degradation. The polystyrene standard peak molecular weights are converted to polyethylene molecular weights using the following equation (as described in Williams and Ward, *J. Polym. Sci., Polym. Let.,* 6, 621 (1968)): $M_{polyethylene}=0.431(M_{polystyrene})$.

Polyethylene equivalent molecular weight calculations are performed using Viscotek TriSEC software Version 3.0.

Density

Samples for density measurement are prepared according to ASTM D 1928. Measurements are made within one hour of sample pressing using ASTM D792, Method B.

ATREF

Analytical temperature rising elution fractionation (ATREF) analysis is conducted according to the method described in U.S. Pat. No. 4,798,081 and Wilde, L.; Ryle, T. R.; Knobeloch, D. C.; Peat, I. R.; *Determination of Branching Distributions in Polyethylene and Ethylene Copolymers*, J. Polym. Sci., 20, 441-455 (1982), which are incorporated by reference herein in their entirety. The composition to be analyzed is dissolved in trichlorobenzene and allowed to crystallize in a column containing an inert support (stainless steel shot) by slowly reducing the temperature to 20° C. at a cooling rate of 0.1° C./min. The column is equipped with an infrared detector. An ATREF chromatogram curve is then generated by eluting the crystallized polymer sample from the column by slowly increasing the temperature of the eluting solvent (trichlorobenzene) from 20 to 120° C. at a rate of 1.5° C./min.

$^{13}C$ NMR Analysis

The samples are prepared by adding approximately 3 g of a 50/50 mixture of tetrachloroethane-$d^2$/orthodichlorobenzene to 0.4 g sample in a 10 mm NMR tube. The samples are dissolved and homogenized by heating the tube and its contents to 150° C. The data are collected using a JEOL Eclipse™ 400 MHz spectrometer or a Varian Unity Plus™ 400 MHz spectrometer, corresponding to a $^{13}C$ resonance frequency of 100.5 MHz. The data are acquired using 4000 transients per data file with a 6 second pulse repetition delay. To achieve minimum signal-to-noise for quantitative analysis, multiple data files are added together. The spectral width is 25,000 Hz with a minimum file size of 32K data points. The samples are analyzed at 130° C. in a 10 mm broad band probe. The comonomer incorporation is determined using Randall's triad method (Randall, J. C.; JMS-Rev. Macromol. Chem. Phys., C29, 201-317 (1989), which is incorporated by reference herein in its entirety.

Block Index

The ethylene/α-olefin interpolymers are characterized by an average block index, ABI, which is greater than zero and up to about 1.0 and a molecular weight distribution, $M_w/M_n$, greater than about 1.3. The average block index, ABI, is the weight average of the block index ("BI") for each of the polymer fractions obtained in preparative TREF (i.e., fractionation of a polymer by Temperature Rising Elution Fractionation) from 20° C. and 110° C., with an increment of 5° C. (although other temperature increments, such as 1° C., 2° C., 10° C., also can be used):

$$ABI=\Sigma(w_i BI_i)$$

where $BI_i$ is the block index for the ith fraction of the inventive ethylene/α-olefin interpolymer obtained in preparative TREF, and $w_i$ is the weight percentage of the ith fraction. Similarly, the square root of the second moment about the mean, hereinafter referred to as the second moment weight average block index, can be defined as follows.

$$2^{nd}\text{ moment weight average } BI = \sqrt{\frac{\sum(w_i(BI_i - ABI)^2)}{\frac{(N-1)\sum w_i}{N}}}$$

where N is defined as the number of fractions with $BI_i$ greater than zero. Referring to FIG. 9, for each polymer fraction, BI is defined by one of the two following equations (both of which give the same BI value):

$$BI = \frac{1/T_X - 1/T_{XO}}{1/T_A - 1/T_{AB}}$$

or $$BI = -\frac{LnP_X - LnP_{XO}}{LnP_A - LnP_{AB}}$$

where $T_X$ is the ATREF (i.e., analytical TREF) elution temperature for the ith fraction (preferably expressed in Kelvin), $P_X$ is the ethylene mole fraction for the ith fraction, which can be measured by NMR or IR as described below. $P_{AB}$ is the ethylene mole fraction of the whole ethylene/α-olefin interpolymer (before fractionation), which also can be measured by NMR or IR. $T_A$ and $P_A$ are the ATREF elution temperature and the ethylene mole fraction for pure "hard segments" (which refer to the crystalline segments of the interpolymer). As an approximation or for polymers where the "hard segment" composition is unknown, the $T_A$ and $P_A$ values are set to those for high density polyethylene homopolymer.

$T_{AB}$ is the ATREF elution temperature for a random copolymer of the same composition (having an ethylene mole fraction of $P_{AB}$) and molecular weight as the inventive copolymer. $T_{AB}$ can be calculated from the mole fraction of ethylene (measured by NMR) using the following equation:

$$LnP_{AB}=\alpha/T_{AB}+\beta$$

where α and β are two constants which can be determined by a calibration using a number of well characterized preparative TREF fractions of a broad composition random copolymer and/or well characterized random ethylene copolymers with narrow composition. It should be noted that α and β may vary from instrument to instrument. Moreover, one would need to create an appropriate calibration curve with the polymer composition of interest, using appropriate molecular weight ranges and comonomer type for the preparative TREF fractions and/or random copolymers used to create the calibration. There is a slight molecular weight effect. If the calibration curve is obtained from similar molecular weight ranges, such effect would be essentially negligible. In some embodiments as illustrated in FIG. 8, random ethylene copolymers and/or preparative TREF fractions of random copolymers satisfy the following relationship:

$$LnP=-237.83/T_{ATREF}+0.639$$

The above calibration equation relates the mole fraction of ethylene, P, to the analytical TREF elution temperature, $T_{ATREF}$, for narrow composition random copolymers and/or preparative TREF fractions of broad composition random copolymers. $T_{XO}$ is the ATREF temperature for a random copolymer of the same composition (i.e., the same comonomer type and content) and the same molecular weight and having an ethylene mole fraction of $P_X$. $T_{XO}$ can be calculated from $LnPX=\alpha/T_{XO}+\beta$ from a measured $P_X$ mole fraction. Conversely, $P_{XO}$ is the ethylene mole fraction for a random copolymer of the same composition (i.e., the same comonomer type and content) and the same molecular weight and having an ATREF temperature of $T_X$, which can be calculated from $Ln\ P_{XO}=\alpha/T_X+\beta$ using a measured value of $T_X$.

Once the block index (BI) for each preparative TREF fraction is obtained, the weight average block index, ABI, for the whole polymer can be calculated.

Mechanical Properties—Tensile, Hysteresis, and Tear

Stress-strain behavior in uniaxial tension is measured using ASTM D 1708 microtensile specimens. Samples are stretched with an Instron at 500% $min^{-1}$ at 21° C. Tensile strength and elongation at break are reported from an average of 5 specimens.

100% and 300% Hysteresis is determined from cyclic loading to 100% and 300% strains using ASTM D 1708 microtensile specimens with an Instron™ instrument. The sample is loaded and unloaded at 267% $min^{-1}$ for 3 cycles at 21° C. Cyclic experiments at 300% and 80° C. are conducted using an environmental chamber. In the 80° C. experiment, the sample is allowed to equilibrate for 45 minutes at the test temperature before testing. In the 21° C., 300% strain cyclic experiment, the retractive stress at 150% strain from the first unloading cycle is recorded. Percent recovery for all experiments are calculated from the first unloading cycle using the strain at which the load returned to the base line. The percent recovery is defined as:

$$\%\text{ Recovery} = \frac{\varepsilon_f - \varepsilon_s}{\varepsilon_f} \times 100$$

where $\epsilon_f$ is the strain taken for cyclic loading and $\epsilon_s$ is the strain where the load returns to the baseline during the $1^{st}$ unloading cycle.

Advantageously, one or more embodiments of the present invention may provide for the production of improved cellulose products, as compared to prior art compositions.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

All priority documents are herein fully incorporated by reference for all jurisdictions in which such incorporation is permitted. Further, all documents cited herein, including testing procedures, are herein fully incorporated by reference for all jurisdictions in which such incorporation is permitted.

What is claimed:

1. A cellulose article comprising:

cellulose fibers incorporating at least a partially dehydrated aqueous dispersion comprising the melt-kneading product of at least one polymer selected from the group consisting of an ethylene-based thermoplastic polymer, a propylene-based thermoplastic polymer, and mixtures thereof, and at least one polymeric stabilizing agent in the presence of 25 to 74 percent by volume of water, based on the total volume of the dispersion, and one or more neutralizing agents, wherein the aqueous dispersion has a pH in the range of from 8 to 11, an average volume particle size diameter in the range of from 0.05 to 2.7 μm, and wherein the aqueous dispersion comprises from 20 to 60 percent by weight of solid content, based on the weight of dispersion, wherein said cellulose article has a specific volume of less than 3 cc/g.

2. The cellulose article of claim 1, wherein said dehydrated aqueous dispersion forms a film having a thickness in the range of less than 15 μm.

3. The cellulose article of claim 2, wherein said dehydrated aqueous dispersion forms a film having a thickness in the range of less than 5 μm.

4. The cellulose article of claim 1, wherein the stabilizer comprises a partially or fully neutralized ethylene-acid copolymer.

5. The cellulose article of claim 1, wherein the ethylene-acid copolymer is neutralized from about 50 percent to about 110 percent on a molar basis.

6. The cellulose article of claim 1, wherein the ethylene-acid copolymer is at least one selected from the group consisting of ethylene-acrylic acid and ethylene methylacrylic acid.

7. The cellulose article of claim 1, wherein the cellulose article has an oil and grease resistance value of at least 9 as measured using the Kit test at an exposure time of 15 seconds.

8. The cellulose article of claim 1, wherein the cellulose article has a water resistance value of less than about 10 $g/m^2/120$ seconds as measured via the Cobb test.

9. The cellulose article of claim 1, wherein the cellulose article has a moisture vapor transmission rate of less than about 200 $g/m^2/24$ hours measured at room temperature and a wet side relative humidity of 70 percent.

10. The cellulose article of claim 1, wherein the article is a paper, paper-board, corrugated box, wall paper, or photographic grade paper.

* * * * *